US012180717B2

(12) United States Patent
Markovski

(10) Patent No.: US 12,180,717 B2
(45) Date of Patent: Dec. 31, 2024

(54) RELEASABLE JOINING SYSTEM FOR FLOOR PANELS

(71) Applicant: VILOX AB, Helsingborg (SE)

(72) Inventor: Bobby Markovski, Helsingborg (SE)

(73) Assignee: VILOX AB, Helsingborg (SE)

( * ) Notice: Subject to any disclaimer, the term of this patent is extended or adjusted under 35 U.S.C. 154(b) by 281 days.

(21) Appl. No.: 17/783,897

(22) PCT Filed: Dec. 11, 2020

(86) PCT No.: PCT/SE2020/051203
§ 371 (c)(1),
(2) Date: Jun. 9, 2022

(87) PCT Pub. No.: WO2021/118448
PCT Pub. Date: Jun. 17, 2021

(65) Prior Publication Data

US 2023/0015897 A1 Jan. 19, 2023

(30) Foreign Application Priority Data

Dec. 13, 2019 (SE) ..... 1951462-9

(51) Int. Cl.
*E04F 15/02* (2006.01)
*E04F 21/22* (2006.01)

(52) U.S. Cl.
CPC ..... *E04F 15/02038* (2013.01); *E04F 21/22* (2013.01); *E04F 2201/0138* (2013.01);
(Continued)

(58) Field of Classification Search
CPC ..... E04F 13/0819; E04F 15/02038; E04F 2201/0146; E04F 2201/023;
(Continued)

(56) References Cited

U.S. PATENT DOCUMENTS 9,260,870 B2 * 2/2016 Vermeulen ..... E04F 15/105
10,119,273 B2 * 11/2018 Andres ..... E04F 15/02458
(Continued)

FOREIGN PATENT DOCUMENTS

WO 2017115202 A1 7/2017
WO 2018172955 A2 9/2018
(Continued)

OTHER PUBLICATIONS

WIPO; App No.; PCT/SE2020/051203; International Report on Patentability mailed Nov. 11, 2021.
(Continued)

*Primary Examiner* — Brent W Herring
(74) *Attorney, Agent, or Firm* — Sterne, Kessler, Goldstein & Fox P.L.L.C.

(57) ABSTRACT

A joining system for floor panels comprising a female coupling formed in a first floor panel and a male coupling formed in a second floor panel, the female coupling comprising: a female coupling recess being arranged on a female coupling tongue protruding away from a main portion of the first panel towards the adjoining second floor panel, the female coupling recess being adapted to receive a male coupling tongue projecting from the adjoining second floor panel in a direction away from a main floor surface plane in which the floor panels are laid, the female coupling further comprises an upper guiding surface being located on a side of the female coupling recess on the first panel forming a guide for the male coupling tongue upon insertion thereof.

20 Claims, 10 Drawing Sheets

(52) U.S. Cl.
CPC ..... *E04F 2201/0146* (2013.01); *E04F 2201/0153* (2013.01); *E04F 2201/0161* (2013.01); *E04F 2201/023* (2013.01); *E04F 2201/042* (2013.01); *E04F 2201/043* (2013.01)

(58) Field of Classification Search
CPC ..... E04F 2201/042; E04F 2201/043; E04F 21/22; E04F 2201/0138; E04F 2201/0153; E04F 2201/0161
USPC ..... 52/588.1
See application file for complete search history.

(56) References Cited

U.S. PATENT DOCUMENTS

| | | | | |
|---|---|---|---|---|
| 10,280,627 | B2 * | 5/2019 | De Rick | E04F 13/0889 |
| 10,648,182 | B2 * | 5/2020 | De Rick | E04F 15/107 |
| 2015/0267418 | A1 * | 9/2015 | Vermeulen | E04F 15/02038 52/582.2 |
| 2015/0267419 | A1 | 9/2015 | Darko | |
| 2017/0254077 | A1 * | 9/2017 | Andres | E04F 15/02183 |
| 2017/0350139 | A1 * | 12/2017 | De Rick | E04F 13/0889 |
| 2019/0017278 | A1 * | 1/2019 | De Rick | E04F 15/105 |
| 2019/0093370 | A1 | 3/2019 | Pervan et al. | |

FOREIGN PATENT DOCUMENTS

| | | | |
|---|---|---|---|
| WO | 2018215550 | A1 | 11/2018 |
| WO | 2019137964 | A1 | 7/2019 |
| WO | 2019138365 | A1 | 7/2019 |
| WO | 2019145521 | A1 | 8/2019 |
| WO | 2019224107 | A1 | 11/2019 |
| WO | 2021111210 | A1 | 6/2021 |

OTHER PUBLICATIONS

WIPO; App No.; PCT/SE2020/051203; International Search Report and Written Opinion mailed May 2, 2021.
EPO; Supplementary Partial European Search Report and Search Opinion; EPO Application No. EP20898174; Mar. 11, 2024 (12 pages).

* cited by examiner

RELEASABLE JOINING SYSTEM FOR FLOOR PANELS

CROSS-REFERENCE TO RELATED APPLICATIONS

This application is a U.S. national phase application of International Application No. PCT/SE2020/051203, filed Dec. 11, 2020, designating the United States, which claims priority to Swedish Application No. 1951462-9, filed Dec. 13, 2019.

FIELD OF THE INVENTION

The invention relates to a joining system for floor panels, comprising a female coupling recess formed in a first floor panel. The female coupling recess is shaped for receiving a male coupling tongue projecting from an adjoining second floor panel in a direction away from a main floor surface plane in which the floor panels are laid. The male coupling tongue is provided with vertical locking means enabling a vertical interlocking engagement with a matching vertical locking means in the female coupling recess.

BACKGROUND ART

A current trend in joining systems for prefabricated floor panels is to use one of many variants of angle-in tongue- and groove joints on the long sides of a typical rectangular floor panels and then use a so-called fold-down joint for joining the remaining short sides of the floor panels. This combined use of angle-in joints and fold-down joints and fold-down joints makes it easier and less time-consuming to lay a floor both for professionals and for DIY (Do-It-Yourself) customers compared with earlier angle-in/angle-in joining systems that required both the long and the short sides of the floor panels to be angled into connection.

A fold-down joining system typically includes some kind of vertical snap-lock action which allows the joint to easily snap in place as the floor panels are folded down into engagement along the short sides of the floor panels. Existing prior-art snap-lock designs for fold-down joints include various forms of vertical locking means, such as angled or rounded locking lugs intended to snap into engagement with corresponding locking recesses—or vice versa. Some fold-down joints include separately inserted resilient plastic or rubber tongue elements for obtaining an efficient and positive locking between two adjoining floor panels. These joints generally function well, although they are also more complicated and thus more expensive to manufacture compared to joints without such separate inserts, rendering them unsuitable for large scale flooring production.

Prefabricated floor panels are manufactured globally in a vast variety of materials and structural designs, such as laminate flooring, wood flooring, LVT (Luxury Vinyl Tiles), PVC to name but a few. All these floor panels have very different material and manufacturing properties and it is far from certain that a particular fold-down joining system which works well in one type of floor panel will work equally well in another type of floor panel of different composition and material. For this reason it is highly desirable for floor manufacturers to find a fold-down joining system which allows for an effective snap-lock action in as many of the widely used floor panel types as possible.

SUMMARY OF THE INVENTION

In view of that stated above, the object of the present invention is to provide a joining system for floor panels which ameliorates some of the problems with prior art solutions.

To achieve at least one of the above objects and also other objects that will be evident from the following description, a joining having the features defined in claim 1 is provided according to the present invention. Preferred embodiments of the device will be evident from the dependent claims.

More specifically, there is provided according to the present invention a joining system for floor panels comprising a female coupling formed in a first floor panel and a male coupling formed in a second floor panel. The female coupling comprising:

- a female coupling recess being arranged on a female coupling tongue protruding away from a main portion of the first panel towards the adjoining second floor panel. The female coupling recess is adapted to receive a male coupling tongue projecting from the adjoining second floor panel in a direction away from a main floor surface plane in which the floor panels are laid. The female coupling further comprises an upper guiding surface being located on a side of the female coupling recess on the first panel forming a guide for the male coupling tongue upon insertion thereof, limiting movement of the male coupling tongue in a horizontal direction towards the main portion of the first floor panel. The male coupling comprises:
- that the male coupling tongue is formed in one piece in the second floor panel, the male coupling is provided with vertical locking means enabling a vertical interlocking engagement with a matching vertical locking means of the female coupling.

The female coupling tongue is resilient and comprises a distally arranged locking protrusion protruding from the female coupling tongue in a direction towards the main floor surface plane and is arranged to be received in a groove in the second panel for horizontal locking of the panels. The locking protrusion is configured to come into contact with the male coupling tongue during joining of the first and second panels. The female coupling tongue further comprising a lower recess enabling the locking protrusion of the female coupling tongue to be depressed during joining of the panels. The joining system further comprises:

- a coupling release channel being arranged between the locking protrusion and an upper surface in the groove in the second panel, such that a coupling release tool placeable in the coupling release channel can engage the female coupling tongue, to depress the female coupling tongue to release the horizontal locking from the locking protrusion and/or to release the vertical locking means. Thereby is a joining system provided which, by the provision of the resilient female coupling tongue, removes the need for a resilient male coupling tongue. The groove can thus made shallower, whereby the load bearing capacity of the joint is improved. The coupling release channel provided further facilitates releasing of the joint.

The recess may in one embodiment extend from a distal surface of the female coupling tongue. The recess may have a greater extension D than the width F of the locking protrusion. A recess extending longer horizontally than the width of the protrusion will facilitate deflection of the female coupling tongue by the male coupling tongue, as a vertical force applied on the locking protrusion will result in a momentum force due to the underlying recess and the momentum force increases with increased extension of the recess past the locking protrusion.

Further still, the recess may extend on the underside of the female coupling tongue a distance D, from a distal surface thereof to between 60% to 90% of the length C of the female coupling tongue, preferably approximately 85% of the length of the female coupling tongue as measured from the distal surface The recess may be defined by an inclined surface extending from a distal surface of the female coupling tongue a distance D, from a distal surface thereof to between 60% to 90% of the length C of the female coupling tongue, preferably approximately 85% of the length of the female coupling tongue as measured from the distal surface.

The locking protrusion may further comprise an inclined abutment surface arranged between an essentially vertical abutment surface on the female locking tongue and the top surface of the female locking tongue. The essentially vertical abutment surface and/or the inclined abutment surface cooperating with an abutment surface on the male coupling tongue to prevent horizontal movement of the panels away from each other. The provision of the inclined abutment surface facilitates insertion of the male coupling tongue into the female coupling recess, as it guides the male coupling tongue into the female coupling recess. The inclined abutment surface is arranged such that the male coupling tongue will abut against it when the vertical locking means are arranged against the upper guiding surface during joining, a vertical force subsequently placed on the second panel will force the female coupling tongue downwards while the male coupling tongue slides on the inclined abutment surface into the female coupling recess.

The first panel may further still comprise a support surface being configured to cooperate with a support surface on the second panel to provide a vertical support when the first and second panel are connected. The support surfaces add to the vertical load bearing capacity of the joining system, further improving the alignment between the floor panels.

In one embodiment, the male coupling tongue is rigid and non-resilient.

The second panel may furthermore comprise an upper joint surface adjoining the support surface, the upper joint surface being configured to abut against an upper joint surface on the first panel when the first and second panels are joined together. The two joint surfaces together with the support surfaces forms an additional load support and increases the structural strength of the joining system.

The support surface and the joint surface on the second panel may together form a protrusion which corresponds to a recess formed by the support surface and the upper joint surface on the first panel.

In one embodiment, a distance M between the upper surface of the groove and a top surface of the locking protrusion when the first and second panels are joined together is between 10% to 40% of the thickness Q of the first and second panel.

A horizontal channel may be provided between the female coupling tongue and a main portion of the second panel. The horizontal channel may enable horizontal movement of the female coupling tongue.

In one embodiment, the horizontal distance N from a distal surface of the female coupling tongue and a distal surface of the main portion of the second panel between 5% and 15% of the length C of the female coupling member. The above relationship between the female coupling tongue and the horizontal distance allows a horizontal movement in the female coupling tongue which may occur during the joining of the panels.

The joining system may further comprise a coupling release rod placeable in the coupling release channel for deflecting the female coupling tongue and thereby release the lock.

The male coupling tongue may in one embodiment comprise a bottom surface configured to face a female coupling recess bottom surface, wherein the shape of the bottom surface corresponds to the shape of the female coupling recess bottom surface. A vertical force placed on the joint will thus be transferred from the male coupling tongue to the female coupling tongue without causing any momentum force, which is desired as it increases the load bearing capacity of the joint and reduces the risk of unintentional deflection of the female coupling tongue.

In one embodiment, the joint surface protrudes a distance H horizontally from the male coupling tongue, the distance being larger than a distance which the vertical locking means protrudes from the male coupling tongue such that the vertical locking means is positioned closer to the main portion of the second panel than the joint surface.

In one embodiment, the inclined surface has an inclination between 5° and 20°.

The male coupling tongue may further comprise a clearance surface, the clearance surface being arranged proximal of and adjacent to the bottom surface on the male coupling tongue, whereby the second panel may be released from the first panel by pivoting the second panel around the male coupling tongue. The clearance surface provides a lower risk of damaging the female coupling tongue and the female locking protrusion during release of the first and second panel by means of pivoting. The joining system can thus be released both by means of the coupling release tool, by pivoting and/or by means of sliding the first and second panel in the longitudinal direction in relation to one another.

The clearance surface may be chamfered or rounded, and an abutment surface of the male coupling tongue may be arranged at angle in relation to the surface plane and configured to abut against an inclined abutment surface on the female locking protrusion.

In a second aspect is a floor panel provided, comprising a female coupling formed along at least one first side of the floor panel for interconnecting the floor panel to a male coupling of a second floor panel, the female coupling comprising:

a female coupling recess being arranged on a female coupling tongue protruding away from a main portion of the first panel towards the adjoining second floor panel. The female coupling recess is adapted to receive a male coupling tongue projecting from the adjoining second floor panel in a direction away from a main floor surface plane in which the floor panels are laid.

An upper guiding surface being located on a side of the female coupling recess on the first panel forming a guide for the male coupling tongue upon insertion thereof, limiting movement of said male coupling tongue in a horizontal direction towards the main portion of the first floor panel.

A vertical locking means configured to cooperate with vertical locking means in the male coupling, enabling a vertical interlocking engagement therewith. The female coupling tongue is resilient and comprises a distally arranged locking protrusion protruding from the female coupling tongue in a direction towards the main floor surface plane and being arranged to be received in a groove in the second panel for horizontal locking of the panels. The locking protrusion is configured to come into contact with the male coupling tongue during joining of the first and second panels. The female coupling tongue further comprises a lower recess enabling the locking protrusion of the female coupling tongue to be depressed during joining of the panels. The female coupling forms at least a part of:

a coupling release channel being arranged between the locking protrusion and an upper surface in the groove in the second panel, such that a coupling release tool placeable in the coupling release channel can engage the female coupling tongue, to depress the female coupling tongue to release the horizontal locking from the locking protrusion and/or to release of the vertical locking means.

In one embodiment, the floor panel further comprises a second female coupling formed along a side substantially perpendicular to the at least one first side of the floor panel, for interconnecting the floor panel to a male coupling of a second floor panel, the second female coupling comprising:

a female coupling recess being arranged on a female coupling tongue protruding away from a main portion of the first panel towards the adjoining second floor panel. The female coupling recess is adapted to receive a male coupling tongue projecting from the adjoining second floor panel in a direction away from a main floor surface plane in which the floor panels are laid.

An upper guiding surface being located on a side of the female coupling recess on the first panel forming a guide for the male coupling tongue upon insertion thereof, limiting movement of said male coupling tongue in a horizontal direction towards the main portion of the first floor panel.

A vertical locking means configured to cooperate with vertical locking means in the male coupling, enabling a vertical interlocking engagement therewith. The female coupling tongue is resilient and comprises a distally arranged locking protrusion protruding from the female coupling tongue in a direction towards the main floor surface plane and being arranged to be received in a groove in the second panel for horizontal locking of the panels. The locking protrusion is configured to come into contact with the male coupling tongue during joining of the first and second panels. The female coupling tongue further comprises a lower recess enabling the locking protrusion of the female coupling tongue to be depressed during joining of the panels. The female coupling forms at least a part of:

a coupling release channel being arranged between the locking protrusion and an upper surface in the groove in the second panel, such that a coupling release tool placeable in the coupling release channel can engage the female coupling tongue, to depress the female coupling tongue to release the horizontal locking from the locking protrusion and/or to release the vertical locking means.

The floor panel may further still comprise a first male coupling formed along a side parallel to the at least one first side of the floor panel for interconnecting the floor panel to a female coupling of a further floor panel. The male coupling comprising:

a male coupling tongue projecting from the floor panel in a direction away from a main floor surface plane in which the floor panels are laid, the male coupling tongue being formed in one piece in the floor panel. The male coupling is provided with vertical locking means enabling a vertical interlocking engagement with the matching vertical locking means of the female coupling.

The male coupling further comprises a groove in the floor panel being arranged to receive the distally arranged locking protrusion protruding from the female coupling tongue for horizontal locking of the panels. The male coupling forms at least a part of:

a coupling release channel being arranged between the locking protrusion and an upper surface in the groove in the floor panel, such that a coupling release tool placeable in the coupling release channel can engage the female coupling tongue, to depress the female coupling tongue to release the horizontal locking from the locking protrusion and/or to release the vertical locking means.

In yet another embodiment, the floor panel further comprises a second male coupling formed along a side substantially perpendicular to the side on which the first male coupling is formed, the second male coupling being adapted for interconnecting the floor panel to a female coupling on a further floor panel, the second male coupling comprising:

a male coupling tongue projecting from the floor panel in a direction away from a main floor surface plane in which the floor panels are laid, the male coupling tongue being formed in one piece in the floor panel. The male coupling is provided with vertical locking means enabling a vertical interlocking engagement with the matching vertical locking means of the female coupling.

The male coupling further comprises a groove in the floor panel being arranged to receive the distally arranged locking protrusion protruding from the female coupling tongue for horizontal locking of the panels. The male coupling forms at least a part of:

a coupling release channel being arranged between the locking protrusion and an upper surface in the groove in the floor panel, such that a coupling release tool placeable in the coupling release channel can engage the female coupling tongue, to depress the female coupling tongue to release the horizontal locking from the locking protrusion and/or to release the vertical locking means.

In one embodiment, the floor panel is rectangular.

In yet another embodiment, the floor panel is square.

The floor panel may in one embodiment have the shape of a parallelogram.

In a third aspect is a flooring system provided comprising a first floor panel having a female coupling according to the first aspect arranged on a short side thereof, a male coupling according to the first aspect arranged on an opposite short side thereof, a female coupling according to first aspect arranged on a long side thereof and a male coupling according to the first aspect being arranged on an opposite long side thereof, the flooring system further comprising a second panel being identical with the first panel but mirrored either in a vertical plane along one of the short sides of the first floor panel or in a vertical plane along one of the long sides of the first floor panel.

In a fourth aspect is a method for joining a first floor panel to a second floor panel and to a third floor panel provided. the first panel having a male coupling according to the first aspect arranged on a first side thereof and a male coupling according to the first aspect arranged on an adjoining second side, the method comprising:

arranging the first panel with the first side against a side of the second floor panel being provided with a female coupling according to the first aspect and with the second side against a side of the third panel being provided with a female coupling according to the first aspect, joining the first and second side of the first panel to the second and third panel, wherein at least the first side of the first panel is joined to the side of the second panel in a vertical motion.

In one embodiment, the first side of the first panel is joined to the side of the second panel in a vertical motion and the second side of the first panel is joined to the side of the third panel in a vertical motion.

In yet another embodiment, the first side of the first panel is joined to the side of the second panel in a vertical motion and the second side of the first panel is joined to the side of the third panel in a folding motion pivoting around the first side of the first panel after joining of the first side of the first panel.

In one embodiment, the method further comprises releasing the first panel from the second panel and/or the third panel by depressing the female coupling tongue on the side of the second panel and/or on the side of the third panel.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

Figure 1A:
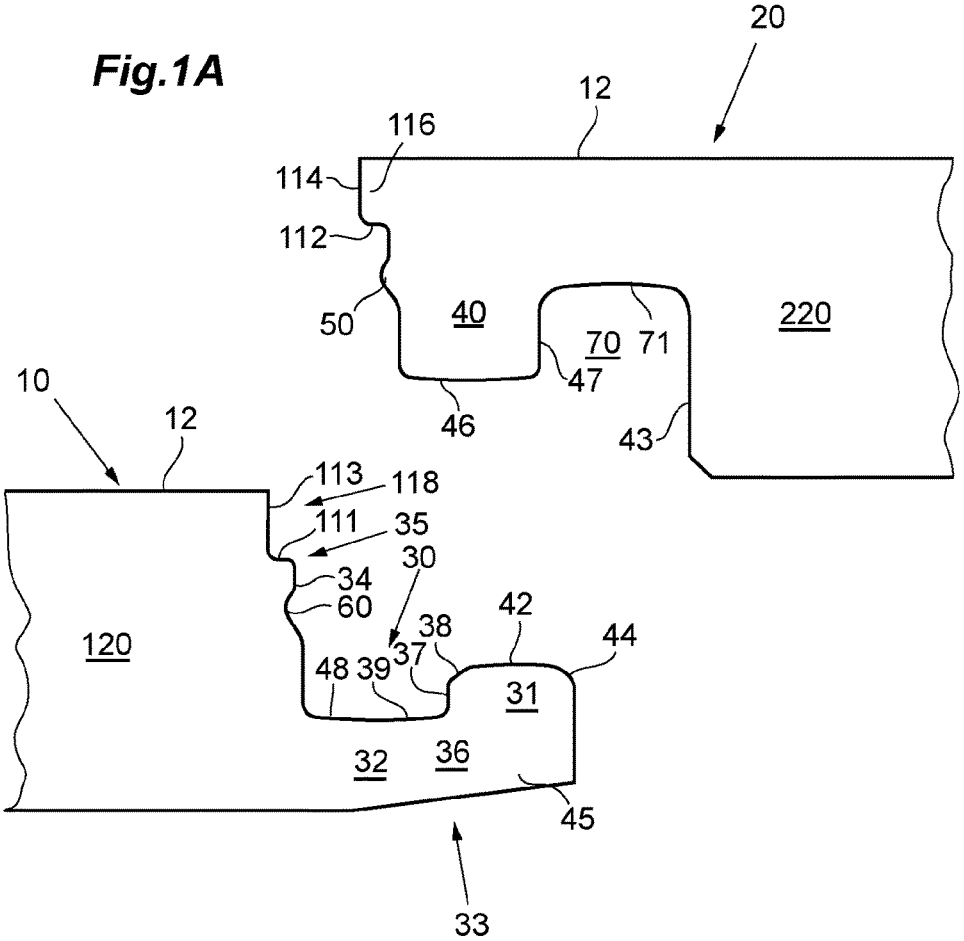
FIG. 1*a* shows a side view of a joining system according to the present invention, as applied on exemplifying floor panels.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Some prior art fold-down joining systems include the use of elasticity slots or grooves located in the vicinity of the vertical locking means. Such elasticity slots will improve the resilient properties of the joint, rendering it more suitable for a wider range of floor panel types in order to avoid undesired stress loads for more brittle materials or composite floor panel designs.

Usually, fold down joining systems with elasticity slots rely on male joint elements that are flexible at least partly by the provision of the elasticity slot such that the can elastically bend during joining of the panels in order to be able to be accommodated by a corresponding female join element. The elasticity slot will however cause a structural weakness in the joint which in some embodiment may be undesired. Furthermore, it is beneficial to be able release the joint in case of if a panel is damaged or incorrectly placed.

Hence it is the object of the present invention to provide a system for joining floor panels which allows a secure and easy joining of floor panels, which provides an improvement of the structural rigidity of the joint and which is releasable.

Although the invention is described hereinafter with more particular reference to rectangular floor panels, it is equally conceivable that the floor panels have any other geometric shape, for example square.

Additionally, variations of the disclosed embodiments can be understood and effected by the skilled person in practicing the claimed invention, from a study of the drawings, the disclosure, and the appended claims.

The floor panels mentioned herein could for example be floor panels comprising a main substrate made of for example wood or a wood-based material such as MDF or HDF, or a main substrate made of SPC (Stone Plastic Composite) or, plastic or composite polymer materials like PVC or LVT or other polymer materials and metals such as aluminium. Additionally, the floor panels comprise a top layer. Examples of top layers are wooden top layers, such as veneer, or decorative films and other layers comprising a printed décor, such as laminate layers of the DPL (Direct Pressure Laminate) or HPL (High Pressure Laminate) type. The top layer may comprise a carrier sheet immersed in resin or in synthetic material, the sheet consists, for example, of paper. The carrier sheet shows a printed décor that is visible at the upper side of the floor panels and forms a so-called decorative layer.

With initial reference to FIGS. 1*a* to 4, these figures show a side view of a joining system as applied on exemplifying floor panels 10, 20, when a second floor panel 20 is being interconnected with a first floor panel 10 by the male coupling of the second floor panel 20 being applied and pressed into the female coupling of the first floor panel 10. The joining system provides a lock in both horizontal (the direction of the plane of the floor) and in the vertical direction which is perpendicular to the direction of the plane of the floor. In the embodiment shown in FIGS. 1 to 4, the floor panels 10, 20 are each provided with a decorative top layer 12. The joining system 10, 20, comprises a female coupling shown formed in a first floor panel 10 and a male coupling shown formed in a second floor panel 20.

Figure 1B:
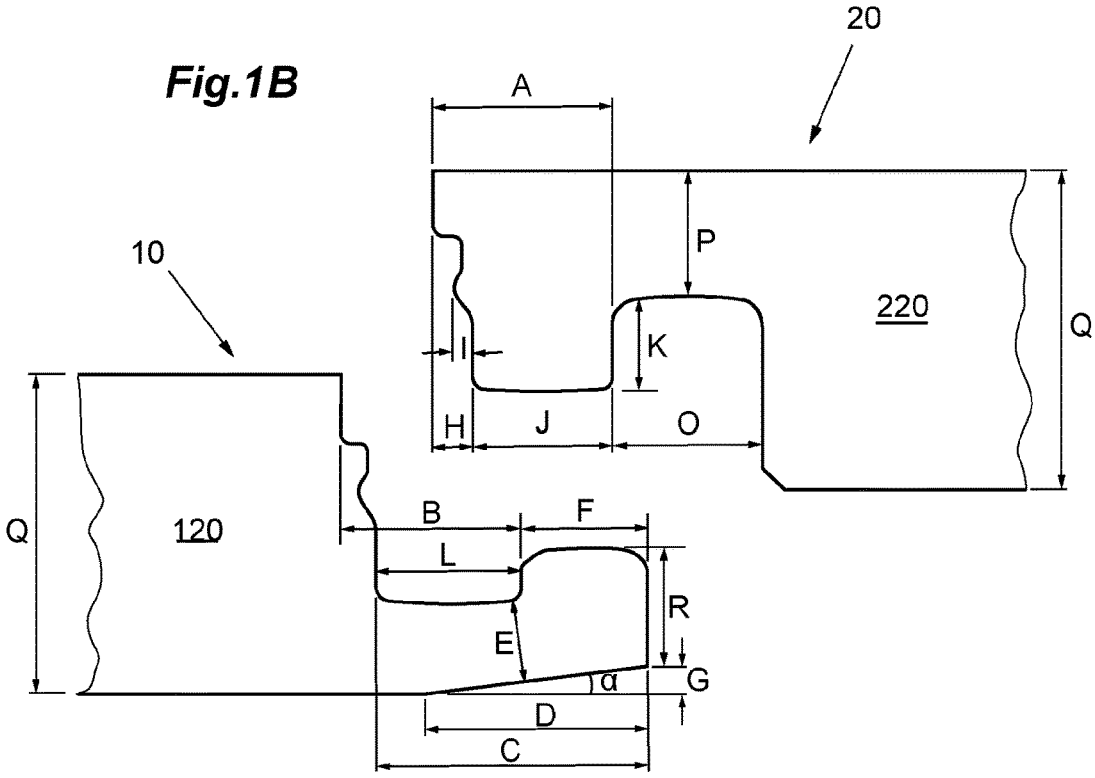
FIG. 1*b* shows a side view of a joining system according to the present invention, in which some defining measurements of the joining system are illustrated.
Figure 2:
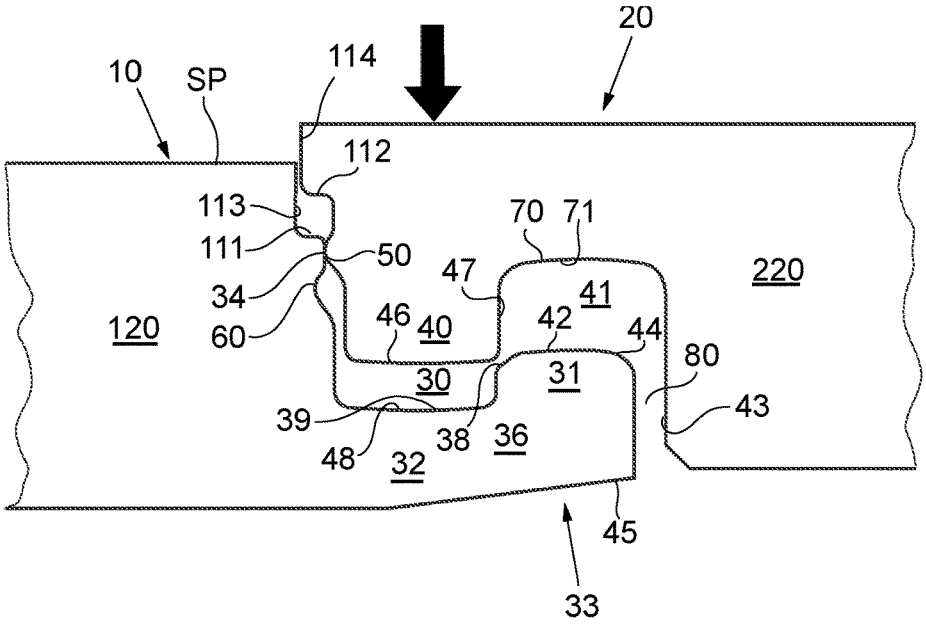
FIG. 2 shows a side view of a joining system according to the present invention, when a first floor panel is being joined with a second floor panel.
Figure 3:
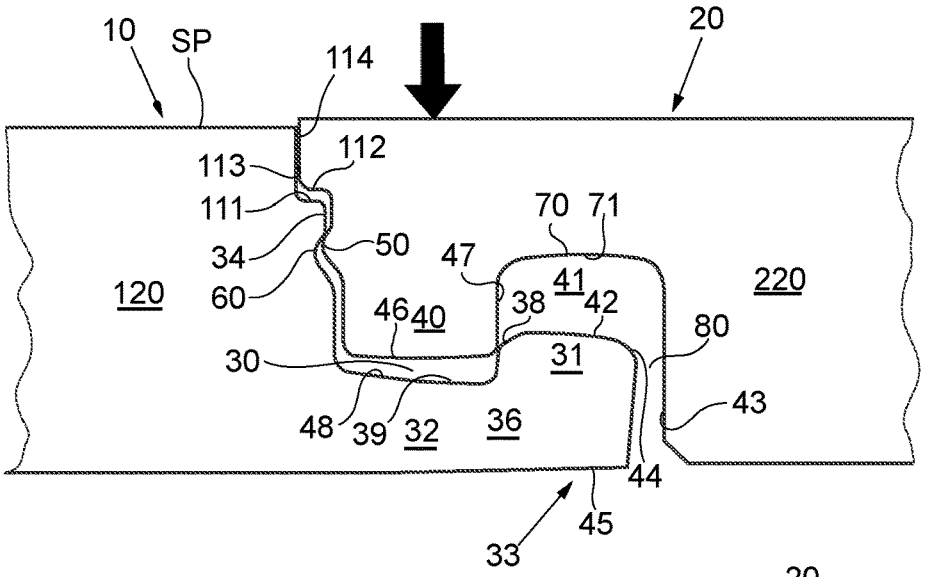
FIG. 3 shows a further side view of the joining system in an intermediate joining position, wherein the female coupling tongue is bent slightly downwards by interaction with the male coupling tongue.

In the embodiment shown in FIGS. 1-3, the respective coupling part is entirely formed in the main substrate of the floor panel, which is made from a homogenous material. However, in other embodiments, it is conceivable that the coupling parts are formed partially in the top layer 12 and/or the that the main substrate is made from a non-homogenous composite material, such that some part of the coupling is essentially formed in a first material whereas a second part of the coupling is essentially formed in a second material, with both materials being part of the main substrate. The female coupling comprises a female coupling recess 30 of the first floor panel 10 having a recess 30 opening in a direction towards the top layer 12. The female coupling recess 30 is arranged on a female coupling tongue 32, which protrudes away from a main portion 120 of the first panel 10. The main portion 120, 220 of the respective first and second panel 10, 20 is to be considered as the portion of each panel 10, 20 that does not include the actual joining system. I.e. the main material of each panel that is not affected by the female and male coupling respectively.

The male coupling tongue 40 preferably has a protrusion length K as measured from an upper surface 71 of a groove 70 in the second panel of between 10% to 40% of a thickness Q of the first and second panel 10, 20, preferably between 20% and 30%.

The female coupling recess 30 of the first floor panel is adapted to receive a male coupling tongue 40 projecting from an adjoining second floor panel 20 in a direction away from a main floor surface plane SP, such as for instance substantially perpendicularly in relation to the main floor surface plane SP in which the floor panels 10, 20 are laid, and away from the top layer 12.

The male coupling tongue 40 comprises a bottom surface 46 configured to face a female coupling recess bottom surface 48. In one embodiment, the shape of the bottom surface 46 corresponds to the shape of the female coupling recess bottom surface 48.

The first floor panel 10 further comprises a locking protrusion 31 protruding from a lower part of the substrate in a direction towards the top layer 12, i.e. towards the main surface plane SP. The locking protrusion 31 is as shown arranged distally on the female coupling tongue 32, forming a horizontal lock which restricts movement of the second panel 20 away from the first panel 10, and vice versa, by its interaction with the male coupling tongue 40.

The female coupling tongue 32 further comprises a lower recess 33 on the opposite side of the female coupling tongue 32 in relation the locking protrusion 31. The lower recess 33 allows the female coupling tongue 32, which is resilient, to temporarily deflect during insertion of the male coupling tongue 40, as will be elaborated on further below.

The second floor panel 20 further comprises a groove 70 formed in the second floor panel 20 and having an opening in a direction away from the top layer 12. The locking protrusion 31 is configured to be positioned in the groove 70 and abut the male coupling tongue 40 and to thereby create a horizontal lock together with the male coupling tongue 40, when the male coupling is engaged in the female coupling. The horizontal width F of the locking protrusion is preferably in the range of 4 mm to 7 mm, even more preferred approximately 5.5 mm. In the embodiment shown in FIGS. 1*a*-4, the horizontal width F is shorter than the horizontal width L of the female coupling recess 30. Having a longer width L makes it easier to make the female coupling tongue 32 sufficiently resilient without the need of a very elastic material. In the embodiment shown in FIGS. 1*a*-4, the horizontal width F is less than half of the entire length C of the female coupling tongue 32. Also, the horizontal width F is larger than the width E of the inclined portion 36, the most narrow portion of which being placed in the areas of the horizontal width L, such that the main resiliance is created along the distance L rather than along the distance F.

The female coupling further comprises a vertical locking means 60 adapted to receive a vertical locking means 50 from the adjoining second floor panel 20. The vertical locking means 50, 60 on the first and second panel 10, 20 respectively prevents vertical misalignment in the joint between the first and second panels 10, 20. It is shown in FIGS. 1-3 that the vertical locking means 50 on the male coupling tongue 40 is in the shape of a bulb 50, which is configure to engage a corresponding in vertical locking means 60 on the female coupling in the shape of a recess 60. However, the recess could equally well be arranged on the male coupling tongue 40 with the bulb being arranged in the female coupling. It is also to be noted that the vertical locking means 50, 60 may take other shape as a triangular protrusion/recess or a rectangular protrusion/recess etc.

The female coupling further comprises an upper guiding surface 34 which is located on a side 35 of the female coupling recess 30 on the first panel 10. The guiding surface 34 forms an essentially non-resilient vertical guide for the male coupling tongue 40 upon insertion thereof, limiting movement of the male coupling tongue 40 in a horizontal direction towards the main portion 120 of the first floor panel 10. The interaction between the male coupling tongue 40 and the guiding surface 34 results in that the male coupling tongue 40 will come into contact with the female coupling tongue 32 during joining of the panels 10, 20, more specifically with the locking protrusion 31 thereof.

Figure 4:
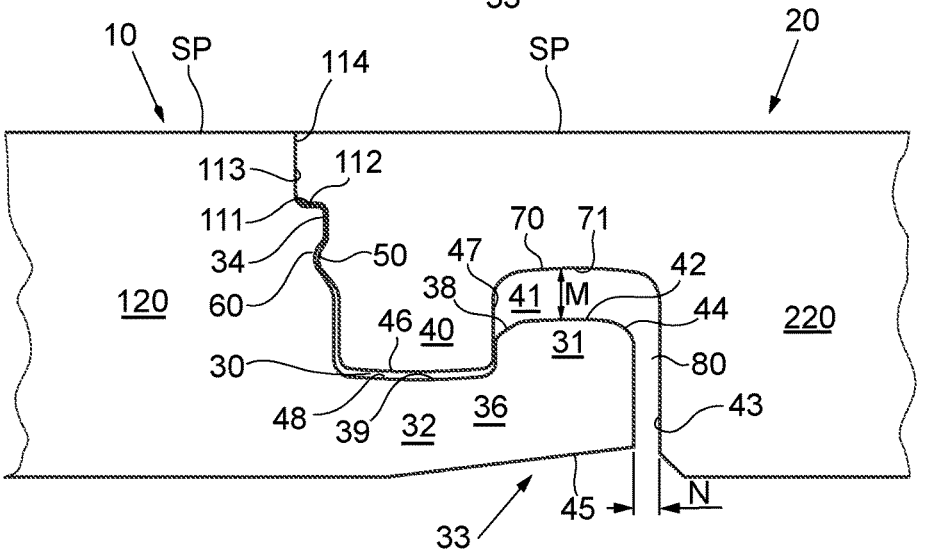
FIG. 4. shows a further side view of the joining system when in a joined, fully engaged and vertically locked state.

The female coupling tongue 32 will need to be depressed, pushed downwards, temporarily (as shown in FIG. 3) for the male coupling tongue 40 to be able to reach its locked position which is shown in FIG. 4. This is enabled as the female coupling tongue 32 comprises the lower recess 33, which allows at least the portion of the female coupling tongue 32 with the locking protrusion 31 to elastically bend to accommodate the male coupling tongue 40. The female coupling tongue 32 is further configured to elastically return from its depressed position once the male coupling tongue 40 reaches its locked position, the female coupling tongue 32 thereby providing a horizontal lock to the joint.

In the embodiment shown in FIGS. 1-4, the joining system further comprises a coupling release channel 41 being part of the male and female coupling for receiving a coupling release rod 110, when the male coupling is locked in the female coupling (which is the state shown in FIG. 3). The coupling release channel 41 can thus be defined between the locking protrusion 31 and an upper surface 71 in the groove 70 of the first and second floor panels 10, 20 respectively. A distance M between the upper surface 71 of the groove 70 and the top surface 42 of the locking protrusion 31 when the first and second panels 10, 20 are joined together may be between may be between 10% to 40% of the thickness Q of the first and second panel 10, 20. In one embodiment, between 15% to 25% of the thickness Q.

Figure 12:
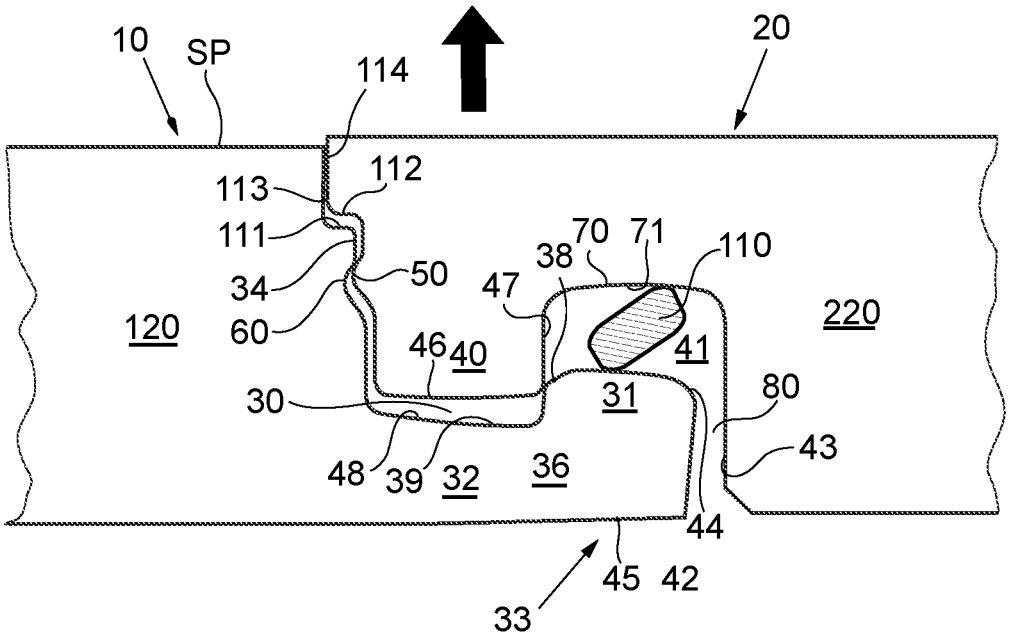
FIG. 12 shows a side view of the joining system when the coupling release rod has been inserted into the coupling release channel pushing the female coupling tongue downwards for unlocking the joining system.

When inserting a coupling release rod 110 into the coupling release channel 41, the female coupling tongue 32 will be pressed downwards until the locking protrusion 31 releases the male coupling tongue 40 such that it can horizontally move in order to release the vertical locking means 50, 60, as is shown in further detail in FIG. 12.

FIG. 3 shows the joining system according to the embodiment shown in FIGS. 1-4, when the second floor panel 20 is being essentially vertically pressed/folded into the first floor panel 10 such that the male coupling tongue 40 presses against the locking protrusion 31 on the female coupling tongue 32. The female coupling tongue 32 deflects downwards as a result. As is shown in FIGS. 1-4, the locking protrusion 31 may comprise an inclined abutment surface 38 arranged between an essentially vertical abutment surface 37 on the female locking tongue 32 and a top surface 41 of the female locking tongue 32. The inclined abutment surface 38 facilitates insertion of the male coupling tongue 40, which may also comprise rounded or chamfered corners. It is to be noted that the inclined abutment surface 38 may also be rounded, providing an increasing inclination towards the female coupling recess 30. Providing rounded/chamfered corners also distributes the loads generated by the contact between the male coupling tongue 40 and the locking protrusion 31, which increases the durability of the joint.

The interaction between the vertical guiding surface 34 and the vertical locking means 50 on the male coupling preferably steers the male coupling tongue 40 such that it pushes against the locking protrusion 31 on the inclined abutment surface 38 during connection of the panels 10, 20. This is accomplished when the vertical locking means 50, which protrudes from the male coupling tongue 40, abuts against the vertical guiding surface 34. This forces the male coupling tongue 40, which preferably has a horizontal width J essentially corresponding to the horizontal width L of the female coupling recess 30, to abut against the inclined abutment surface 38. In one embodiment, the horizontal width J of the male coupling tongue 40 is between 5 mm and 7 mm. The horizontal width L of the female coupling recess 30 may be between 5 mm and 7 mm. The horizontal width J as well as the vertical thickness P are both wider than the thickness E, making the female coupling tongue 32 more resilient than the male coupling tongue 40, such that the main resilience and movement is performed by the female coupling tongue 32.

FIG. 4 shows the joining system according to the embodiment shown in FIGS. 1-3 in a joined, fully engaged and vertically locked state. The female coupling tongue 32 which was deflected in the state shown in FIG. 2 has now resiliently returned to form a horizontal lock and is securely positioned the locking protrusion 31 in the groove 70, whilst the vertical locking means 50, 60 on the first and second panel 10, 20 are mutually engaged, providing a vertical lock. The male coupling tongue 40 is lowered all the way into the first female coupling recess 30. In one embodiment may the female coupling tongue 32 be configured to not be allowed to entirely return to its relaxed state when the male coupling tongue 40 is in the female coupling recess 30. The locking protrusion 31 could then provide a pretensioning force to the joint, reducing the risk of gaps forming between the first and second panels 10, 20.

Figure 19:
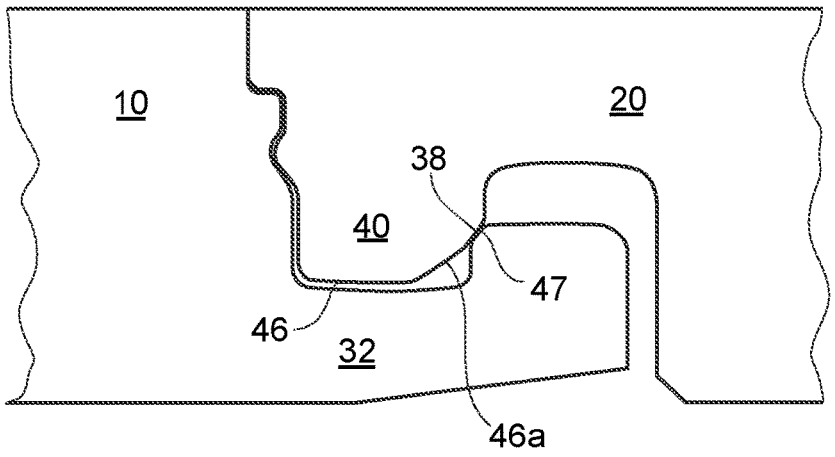
FIG. 19 shows a side view of the joining system according to one embodiment.

The horizontal locking by the female coupling tongue 32 may be formed by the essentially vertical abutment surface 37 on the locking protrusion 31 which may cooperate with an abutment surface 47, which is also essentially vertically arranged, on the male coupling tongue 40. It may also be formed by the inclined abutment surface 38 as shown in FIG. 19.

As can be seen in the fully engaged state shown in FIG. 4, a horizontal channel 80 between the female coupling tongue 32 and a main portion 220 of the second panel 20 is provided. The horizontal channel 80 between a distal surface 44 of the female coupling tongue 32 and a distal surface 43 of the second panel 20 enables horizontal movement of the female coupling tongue 32, which is desired as bending of the female coupling tongue 32 may cause a horizontal movement as well. The horizontal channel 80 width N, i.e. the horizontal distance N from the distal surface 44 of the female coupling tongue 32 to the distal surface 43 of the second panel 20, is between 5% and 15% of the length C of the female coupling member 32. In one embodiment, the distance (or width) N is dependent on the height R of the locking protrusion 31. An increase in the height of the locking protrusion 31 will generate an increase in the horizontal movement when the female coupling tongue 32 is depressed during joining of the panels 10, 20. The horizontal distance N could thus be between 5% and 25% of the height R of the locking protrusion 31.

What can further be seen in the embodiment of FIGS. 1 to 4 is that the lower recess 33 on the female coupling tongue 32 may extend from the distal surface 44 of the female coupling tongue 32 and may have a greater extension D than the width F of the locking protrusion 31. This facilitates deflection/depression of the female coupling tongue 32, as the force from the male coupling tongue 40 is exerted onto the locking protrusion 31. The force thus generates a momentum force in the female coupling tongue 32 due to the lower recess 33 which causes it to bend temporarily, as shown in FIG. 3.

The lower recess 33 in the female coupling tongue 32 may further be formed by an inclined surface 45 extending a distance D from the distal surface 44 of the female coupling tongue 32 to between 60% to 90% of the length C of the female coupling tongue 32, preferably approximately 85% of the length C of the female coupling tongue 32 as measured from the distal surface 44. The inclined surface may have an inclination a between 5° and 20°, preferably approximately 7°.

In order to avoid an excessive narrowing of the material between the inclined surface 45 and the recess 30 in the female coupling tongue 32, the female coupling recess bottom surface 48 may comprise an inclined recess portion 39 may be provided opposite the inclined surface 45. If the female coupling recess 30 had an entirely flat bottom surface 48 without the inclined recess portion 39, the distal corner of the female coupling recess bottom surface 48 and the inclined surface 45 on the underside of the female coupling tongue 32 would result in a potentially structurally weakend female coupling tongue 32, which may in some embodiments be undesireable. The two opposite inclined surface 45 and the inclined recess portion 39 prevents this and provides improved structural integrity to the female coupling tongue 32. The inclined surface 45 and the inclined recess portion 48 forms an inclined portion 36 of the female coupling tongue 32. The inclined portion 36 has a thickness E which at least partly defines the elasticity of the female coupling tongue 32, more specifically the force required for depression of the female coupling tongue 32. The thickness E is as mentioned preferably less than the thickness P of the second panel 20. In one embodiment, the thickness E is approximately 50% to 80% of the thickness P. The female coupling tongue 32 may instead or additionally be made out of a material having a lower elastic modulus than the material of the male coupling, facilitating that the elastic deformation is performed by the female coupling and not by the male coupling.

The male coupling may be supported vertically by the female coupling tongue 32, more specifically by the interaction between the male coupling tongue 40 and bottom of the female coupling recess 30 in the female coupling tongue 32. The vertical locking means 50, 60 on the first and second panel 10, 20 respectively adds to the vertical support.

In one embodiment, in order to increase the vertical load bearing capacity in the joint and to improve the vertical alignment between the first and second panel 10, 20, the first panel may comprise a support surface 111 being configured to cooperate with a support surface 112 on the second panel 20. The support surfaces 111, 112 are horizontally arranged but oppositely facing such that a ledge is formed by the surface 111 on the first panel 10, on which the support surface 112 on the second panel 20 abuts when the two panels are joined together. Preferably, the support surface 111 on the first panel 10 faces upwards and the support surface 112 on the second panel 20 faces downwards.

The support surfaces 111, 112 facilitates distribution of vertical loads exerted on the joint and prevents unintentional depression of the male coupling tongue 40 when the first and second panel 10, 20 are connected. The support surface 111 on the first panel 10 is arranged on the proximally of the female coupling recess 30 and the support surface 112 on the second panel 20 is arranged distally of the male coupling tongue 40.

The second panel may further comprise an upper joint surface 114 adjoining the support surface 112, which is configured to abut against an upper joint surface 113 on the first panel 10. At least one of the joint surfaces 113, 114 may in one embodiment be vertically arranged. However, in one embodiment which is shown FIGS. 17 and 18, they may be arranged with a negative angle such that a small space is created at a lower portion, i.e. close to the support surfaces 111, 112, between the joint surfaces 113, 114 when the panels 10, 20 are joined together. Thereby will only the upper portions of the joint surfaces 113, 114 abut when the panels 10, 20 are joined. In another embodiment, at least one of the joint surfaces 113, 114 may comprise a cutout forming a space at a lower portion of the joint surfaces 113, 114, close to the support surfaces 111, 112. Forming a space at least at a lower portion between the joint surfaces 113, 114 is beneficial for manufacturing purposes. For instance, dust or removed material which may inadvertently be left from the manufacturing process can collect in said space and will thus not cause any tolerance problems that may otherwise occur if the joint surfaces were entirely vertically arranged.

The support surface 112 and the joint surface 114 on the second panel 20 together form a protrusion 116 which corresponds to a recess 118, i.e. the shelf, formed by the support surface 111 and the upper joint surface 113 on the first panel 10. Preferably, the upper joint surface 114 on the second panel 20 protrudes a distance H being larger than a distance I which vertical locking means 50 protrudes. In the embodiment shown in FIGS. 1A-4, the distance I is also substantially shorter than the horizontal width L of the female coupling recess 30, making the female coupling tongue more resilient than the vertical locking means 50.

The horizontal distance A, shown in FIG. 1, between the joint surface 114 and the vertical abutment surface 47 on the male coupling is preferably approximately equal to the horizontal distance B, shown in FIG. 1*b*, between the vertical abutment surface 37 on the locking protrusion 31 and the joint surface 113 on the female coupling. This is desired to reduce the risk of gaps forming in the joint between the panels 10, 20.

In FIG. 1*b*, which shows a side view of the joining system in which a number of measurements of the joining system are illustrated on the first and second panels 10, 20. In one embodiment, the distance G, defining the height of the lower recess 33 at the distal edge of the female coupling tongue 32, is approximately equal to or larger than the vertical overlap between the male coupling tongue 40 and the vertical abutment surface 37 of the locking protrusion 31 when the panels 10, 20 are joined together. This facilitates that the horizontal locking from the locking protrusion 31 is removed when the locking protrusion 31 is depressed, in order to release panels 10, 20 from each other.

Preferably, the horizontal width F of the locking protrusion is equal to or smaller than the horizontal width O of the groove 70.

Figure 5:
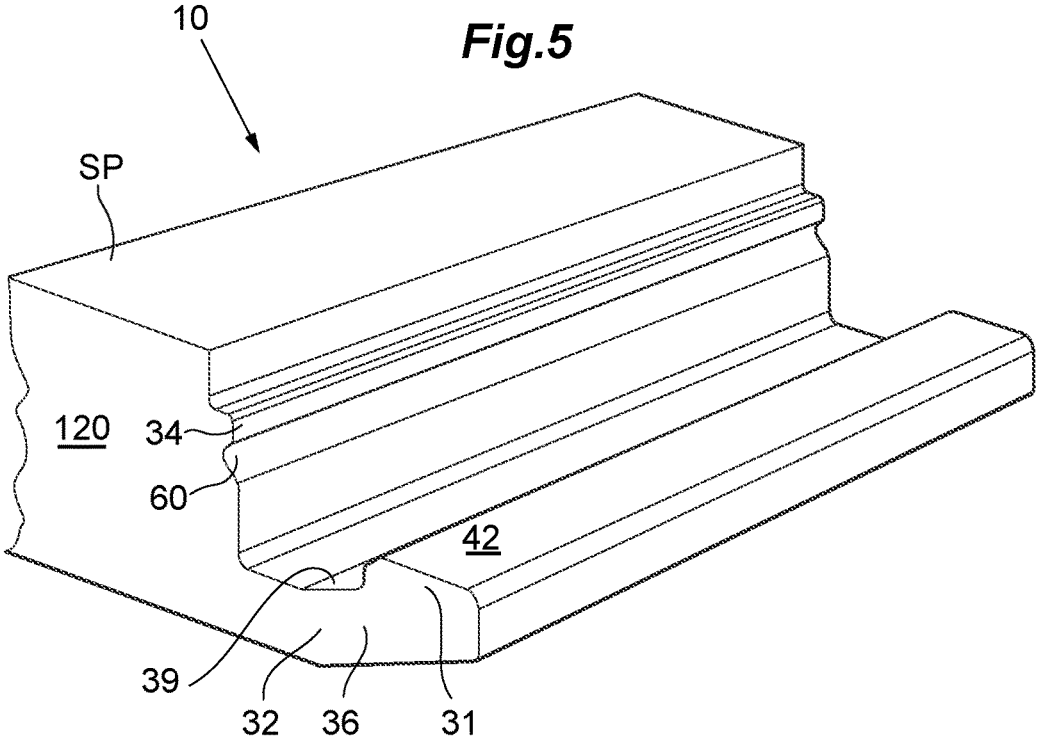
FIG. 5 shows a broken perspective view of a first floor panel showing the female coupling.

Turning now to FIG. 5 which shows a perspective view of a first floor panel 10 showing the female coupling of the embodiment shown in FIGS. 1-4. The perspective view shows that the female coupling extends along the length of one side of the floor panel 10.

Figure 6:
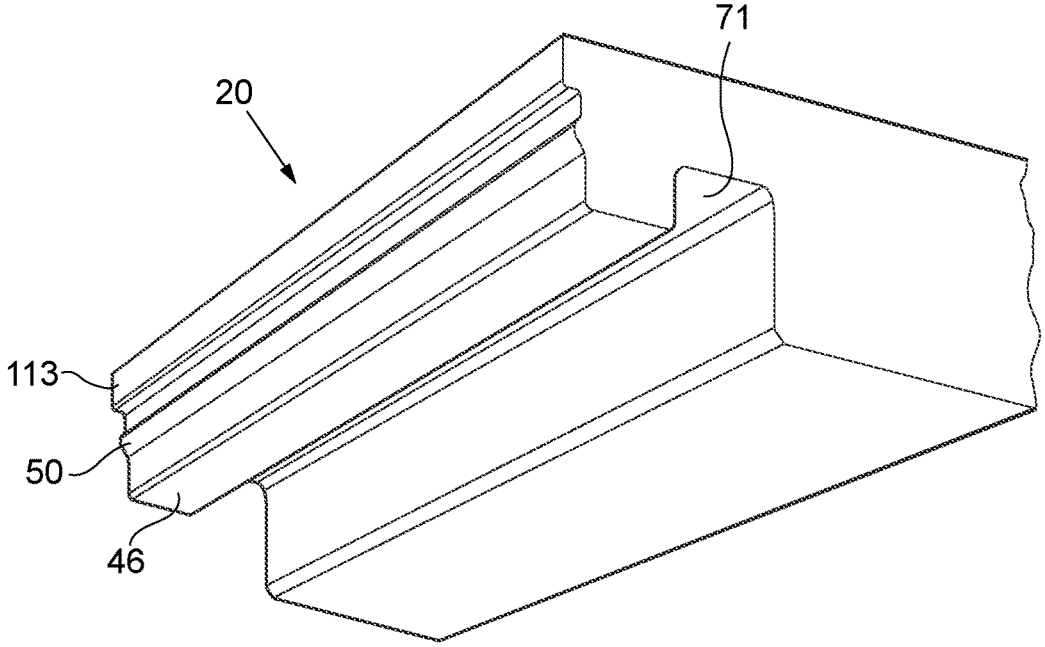
FIG. 6 shows a broken perspective view of a second floor panel showing the male coupling.

FIG. 6 shows a perspective view of a second floor panel 20 showing the male coupling. The perspective view shows that the male coupling extends along the length of one side of the second floor panel 20. The male and female couplings of the first 10 and second 20 floor panels, respectively, can be connected to each other along the entire length (or width) of the floor panels, which creates strong releasable joint between the floor panels. In the embodiments shown in FIGS. 5 and 6 the couplings are shown only along a first side of the floor panel. However, in alternative embodiments the female coupling could run along at least one of the long sides and at least one of the short sides of a rectangular floor panel.

Figure 7:
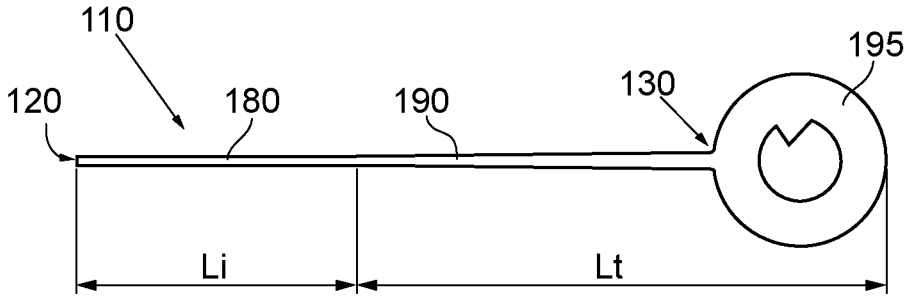
FIG. 7 shows a side view of a coupling release rod, in a first embodiment.

FIG. 7 shows a coupling release rod 110 according to a first embodiment. The coupling release rod 110 comprises an introductory section 180 with a constant cross-sectional area, extending from a tip portion 120 to a tapered unlocking section 190 with an increasing cross-sectional area towards the base portion 130 of said coupling release rod 110. The length Lt of the tapered unlocking section 190 may exceed the length Li of the introductory section 180. The introductory section 180 may provide for facilitated guiding of the coupling release rod 110 into the coupling release channel 90 (shown in FIGS. 1-6 and 13-14) before the tapered unlocking section 190 start to push the second male coupling tongue 50 for release. The length Li of the introductory section may be from 30% to 50% of the length Lt of the tapered unlocking section 190 in some examples. The length Li of the introductory section 180 may in one advantageous example be 40% of the length Lt of the tapered unlocking section 190. FIG. 6 further shows a first example of a tapered coupling release rod 110 where the tapering unlocking section 190 exhibits a linear tapering profile.

Figure 8:
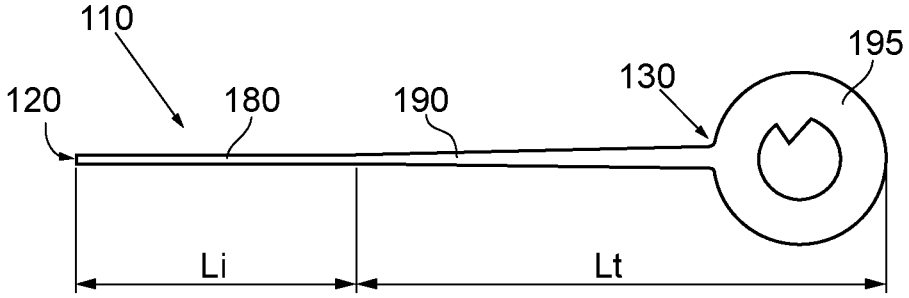
FIG. 8 shows a side view of a coupling release rod, in a second embodiment.
Figure 9:
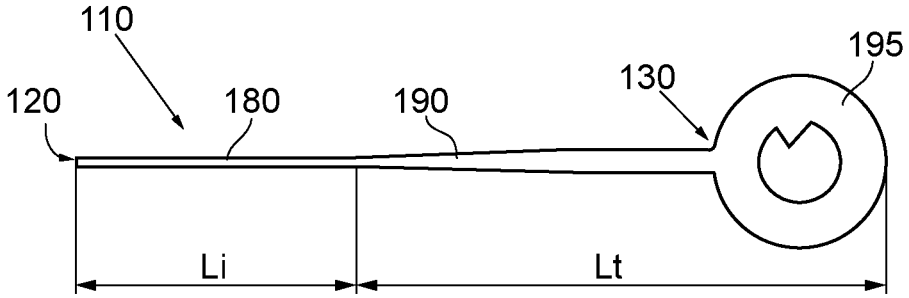
FIG. 9 shows a side view of a coupling release rod, in a third embodiment.

FIG. 8 shows a second example of a tapered coupling release rod 110, where the tapering unlocking section 190 exhibits a concave tapering profile. As seen in FIGS. 7-9 the coupling release rod 110 may comprise a manipulation handle 195 at its base portion 130. The coupling release rod 110 may be made of a polymer material. It may alternatively, or in addition, be made of other materials such as metal.

Figure 10:
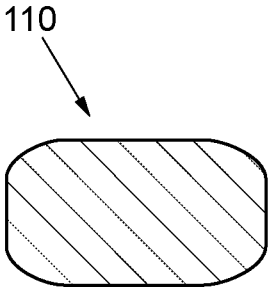
FIG. 10 shows a cross-section a coupling release rod, in one embodiment.

FIG. 10 shows a cross-sectional view of a first exemplary cross-sectional shape of the coupling release rod 110. In this example the coupling release rod 110 comprises a generally rectangular cross-section.

Figure 11:
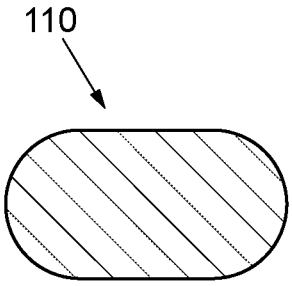
FIG. 11 shows a cross-section a coupling release rod, in a different embodiment.

FIG. 11 shows a cross-sectional view of a second exemplary cross-sectional shape of the coupling release rod 110. In this example the coupling release rod 110 also comprises a generally rectangular cross-section, although here it is more rounded at the edges.

FIG. 12 shows a side view of the joining system as applied on exemplifying floor panels 10, 20, in the same embodiment as shown in FIGS. 1-4. In the state shown in FIG. 12, the coupling release rod 110 has been inserted into the coupling release channel 41, such that the coupling release rod 110 pushes the female coupling tongue 31 downwards. The male coupling tongue 40 is consequently released from its locked state in the female coupling recess 30, such that it can horizontally pass the locking protrusion 31. As the male coupling tongue 40 of the second floor panel 20 can be horizontally shifted in relation to the first floor panel 10 when the horizontal look has been released by the deflection of the female coupling tongue 32, the male coupling tongue 40 can be lifted/folded out from the first female coupling recess 30. This will further also disengage the vertical locking means 50, 60 as a result. The second floor panel 20 can thus be disengaged from the first floor panel 10.

The coupling release rod 110 may be at least partly tapered having an increasing cross-sectional area from, or at a distance from, a tip portion thereof towards a base portion thereof (as shown in FIGS. 7-9). Thus, as the coupling release rod 110 is gradually inserted into the coupling release channel 41, the increasing size of the cross section may push against the female coupling tongue 32. Having an at least partly tapered coupling release rod 110 may in some examples facilitate the deflection of the female coupling tongue 32 and the separation of the joining system.

Figure 13A:
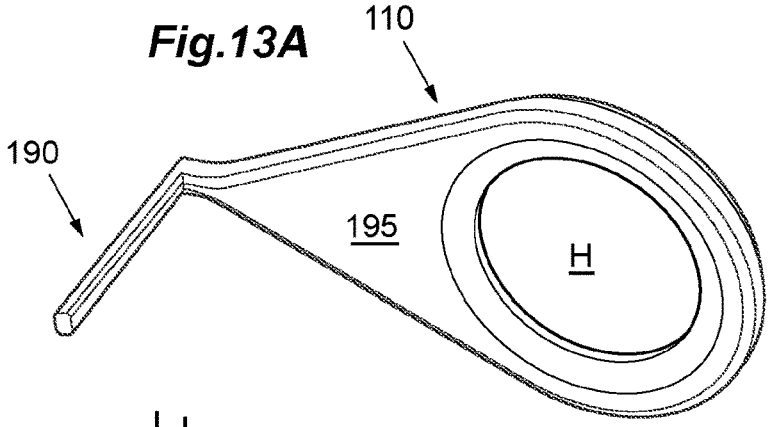
FIGS. 13A, 13B, and 13C show further embodiments of a coupling release rod.

FIG. 13A shows a further embodiment of a coupling release rod 110 in which the unlocking section 190 of the coupling release rod 110 is substantially perpendicular to the manipulation handle 195. The manipulation handle 195 comprises a hole H adapted for receiving at least one finger for manipulation of the coupling release rod 110.

Figure 13B:
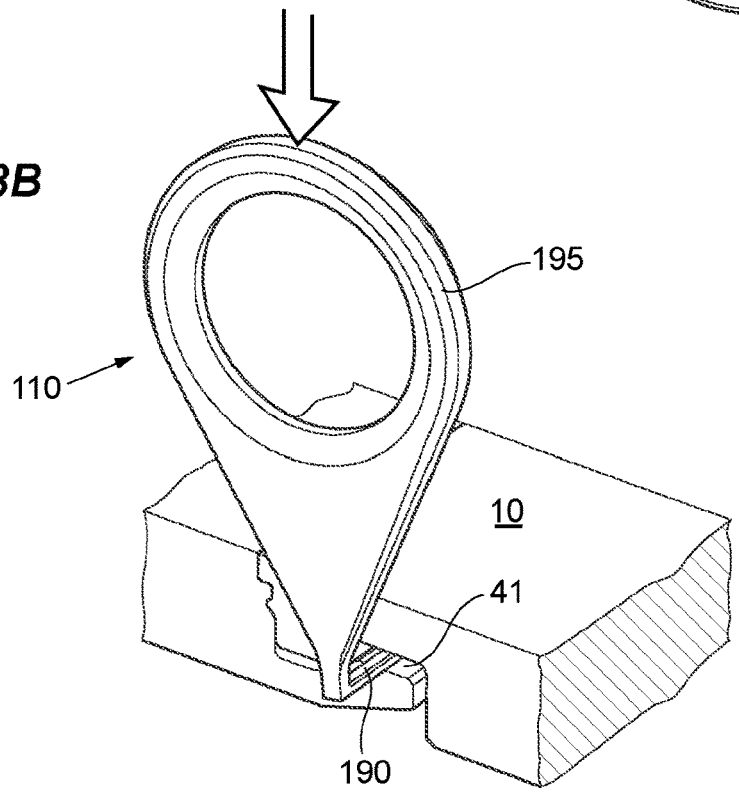

FIG. 13B shows the coupling release rod 110 shown in FIG. 13A when it is operated by a pushing/bending action on the manipulation handle 195 after the unlocking section 190 has been inserted into the coupling release channel 41. The unlocking section 190 pushes female coupling tongue 32, specifically the locking protrusion 31 thereof, (as shown in FIG. 11) downwards and, due to the bending movement of the female coupling tongue 32, slightly to the right in the horizontal channel 80, such that the male coupling tongue 40 is released from its locked state in the female coupling recess 30. It is sufficient to only release a small longitudinal portion of the joint, typically on one end of the panels 10, 20, as this will allow release of the remaining joint by lifting the second panel 20 which will release the remaining portions of the joint.

Figure 13C:
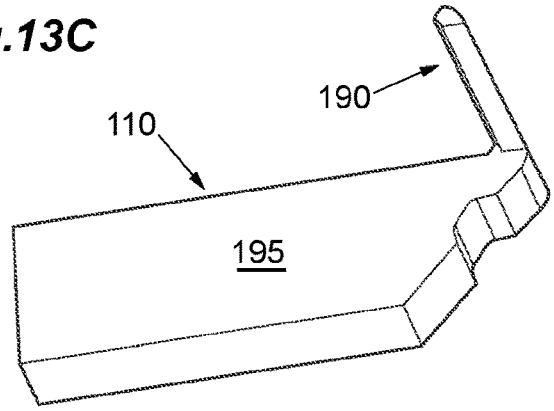

FIG. 13C shows a further embodiment of a coupling release rod 110 in which the unlocking section 190 of the coupling release rod 110 is substantially perpendicular to the manipulation handle 195. It is operated by a turning action on the manipulation handle 195 in which the manipulation handle 195 is turned downwards around a rotational center positioned in the unlocking section 190, after the unlocking section 190 has been inserted into the coupling release channel 41. The cross-sectional geometry of the unlocking section 190 is unsymmetrical and creates a pushing action on the female coupling tongue 32 when turned. The female coupling tongue 32 is pushed downwards into the recess 33, such that the male coupling tongue 40 is released from its locked state in the female coupling recess 30.

Figure 14:
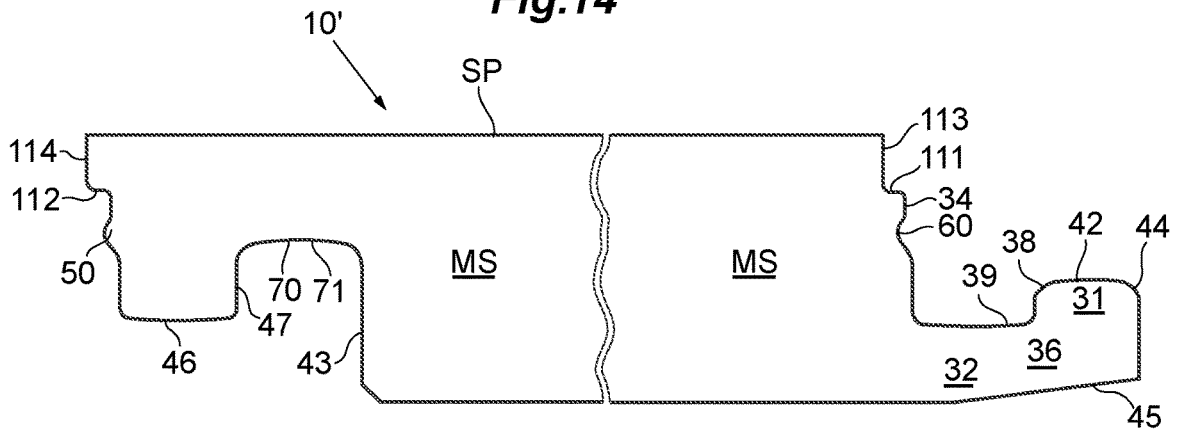
FIG. 14 shows a floor panel in a broken side view. The floor panel comprises a male coupling on the left side and a female coupling on the right side.

FIG. 14 shows a rectangular floor panel 10' according to a first embodiment. The rectangular floor panel comprises a female coupling formed in one piece along at least one side of the rectangular floor panel 10' for interconnecting the floor panel 10' to a second floor panel (not shown). The female coupling comprises a female coupling recess 30 being arranged on a female coupling tongue 32 and adapted to receive a male coupling tongue 40 projecting from an adjoining second floor panel in a direction away from a main floor surface plane SP in which the floor panel 10' is laid. The male coupling tongue 40 may project substantially perpendicularly in relation to the main surface plane SP. The male coupling tongue 40 may project away from the top plane 12 and substantially perpendicularly in relation to the top plane 12.

The female coupling tongue 32 further comprises a lower recess 33, arranged distally on the female coupling tongue 32. The female coupling tongue 32 further comprises a distally arranged locking protrusion 31, which protrudes upwards from the female coupling tongue 32 towards the main floor surface plane SP. The locking protrusion 31 is configured to be arranged in a groove 70 of the adjoining second panel to form a horizontal lock therewith. The recess 33 allows the female coupling tongue 32 to be depressed by interaction with the male coupling tongue 40 and to resiliently snap back into place with the locking protrusion 31 in the groove 70 when the male coupling tongue 40 is in the female coupling recess 30.

The floor panel 10' shown in FIG. 14 further comprises a male coupling (on the left side in the figure) formed along a side parallel, and opposite to, the side in which the female coupling is formed. The male coupling is adapted for interconnecting the floor panel 10' to a further floor panel 20.

The male coupling comprises a male coupling tongue 40 formed in one piece in the floor panel 10'. The groove 70 is adapted to leave room for the female coupling tongue 32 to deflect when forming the snap joint interlocking engagement.

The groove 70 together with the locking protrusion 31 forms a coupling release channel 41 for receiving a coupling release rod. The coupling release rod (as shown in FIG. 12) is placeable in the coupling release channel 41 to deflect the female coupling tongue 32 and thereby release the horizontal lock and thus also the vertical lock, such as further described with reference to FIG. 11.

Figure 15:
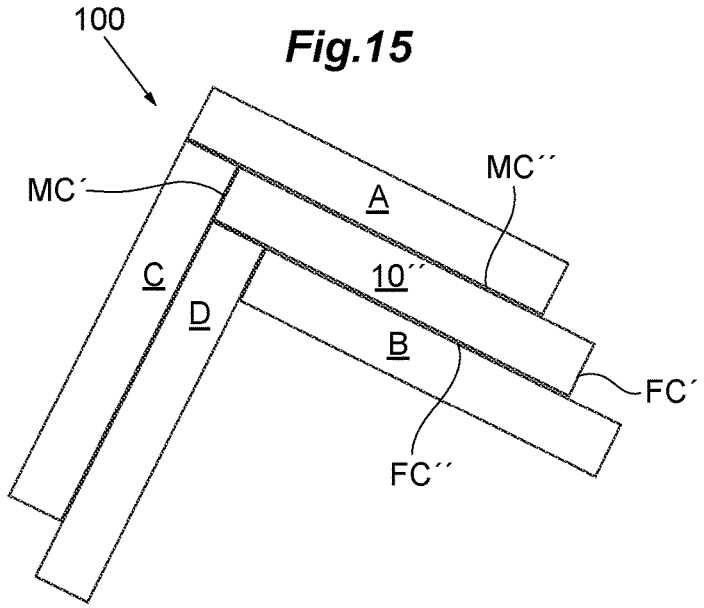
FIG. 15 shows a flooring system with floor panels laid in a herringbone pattern.

FIG. 15 shows a flooring system 100 comprising a floor panel 10" when being interconnected with adjoining floor panels A, B, C, D in a herringbone pattern. The floor panel 10" is rectangular and comprises a male coupling MC' along a first short side of the floor panel 10" and a male coupling MC" along a first long side of the floor panel 10". The male coupling MC' along the first short side of the floor panel 10" is the male coupling as described with reference to FIGS. 1-4, 6, 12 and 14 whereas the male coupling MC" along the first long side of the floor panel may be the male coupling as described with reference to FIGS. 1-4, 6, 12 and 14 or different male coupling configured to be joined with a female coupling of the floor panel A by means of an angling motion.

The floor panel 10" further comprises a second short side having a female coupling FC' and a second long side having a female coupling, both female couplings being the female couplings as described with reference to FIGS. 1-5, 12 and 14. The adjoining floor panels A, B are identical to the floor panel 10" and thus each have the same set of two male and two female couplings on substantially perpendicular short and long sides sharing a common edge. The panels C and D are mirrored in relation to the essentially perpendicularly arranged panels 10', A, B such that if the panel 10' has the following side type pattern listed in the clockwise direction, starting with the short side with the male coupling C: MC'-MC'-FC'-FC', the panels C and D has the clockwise pattern MC'-FC'-FC'-MC' when starting with the short side with the male coupling. Naturally, which is realized by the skilled person, the opposite arrangement could also be the case. In other words, the panels C, D are identical with the first panel 10" but mirrored either in a vertical plane along one of the short sides of the first floor panel 10" or in a vertical plane along one of the long sides of the first floor panel 10".

If a mistake is made when installing the floor, or if a floor panel needs to be replaced for some reason, the coupling between two panels on at least the short ends can be released with the use of the coupling release rod shown in FIGS. 7-9. In the herring bone example shown in FIG. 15, the coupling between the short side of floor panel B coupled to the long side of floor panel D needs to be released. After this coupling has been released the coupling between floor panel B and floor panel 10" can be released by means of the coupling release rod.

Figure 16:
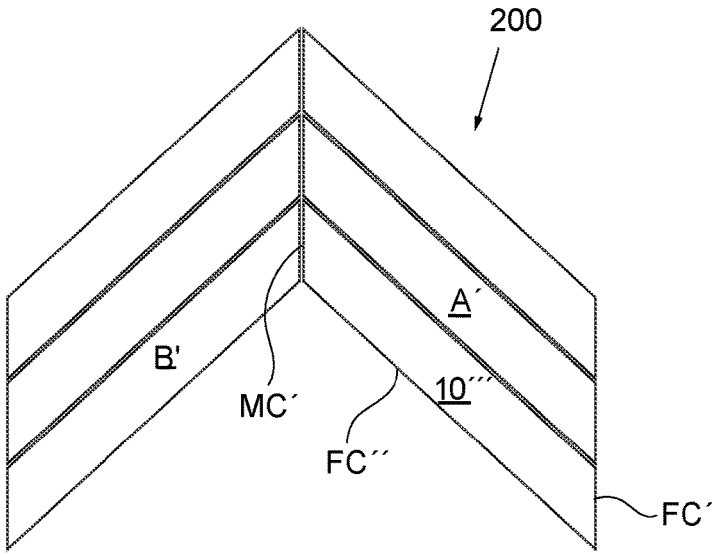
FIG. 16 shows a flooring system with panels laid in a chevron pattern.

FIG. 16 shows a flooring system 200 comprising a floor panel 10'" when being interconnected with adjoining floor panels A', B' in a chevron pattern. The floor panel 10'" has the shape of a parallelogram and comprises a male coupling MC' along a first short side of the floor panel 10'" and a male coupling MC" along a first long side of the floor panel 10'". The male coupling MC' along the first short side of the floor panel 10" is the male coupling as described with reference to FIGS. 1-4, 6, 12 and 14, whereas the male coupling MC" along the first ling side of the floor panel may be the male coupling as described with reference to FIGS. 1-4, 6, 12 and 14 or different male coupling configured to be joined with a female coupling of the floor panel A' by means of an angling motion.

The floor panel 10'" further comprises a second short side having a female coupling FC' and a second long side having a female coupling, both female couplings being the female couplings as described with reference to FIGS. 1-5, 12 and 14. The adjoining floor panel A' is identical to the floor panel 10'" and thus have the same set of two male and two female couplings on adjacent short and long sides sharing a common edge. The panel B', and each panel on below and above it is mirrored in relationship to the panels A', 10'" in the plane of the joint between the two rows of panels. The panels which are to be arranged to the left of panel B' will be identical to the panel A, 10'" etc., as is customary in chevron pattern floor panels and which is realized by the skilled person. In other words, the panel B' is identical with the first panel 10'" but mirrored in a vertical plane along one of the short sides of the first floor panel 10'".

If a mistake is made when installing the floor, or if a floor panel needs to be replaced for some reason, the coupling between two panels on at least the short ends can be released with the use of the coupling release rod shown in FIGS. 7-9. In the chevron example shown in FIG. 16, the coupling between the short side of floor panel B' coupled to the short side of floor panel 10'" needs to be released. After this coupling has been released the coupling between floor panel 10'" and floor panel A' can be released by means of the coupling release rod.

Figure 17:
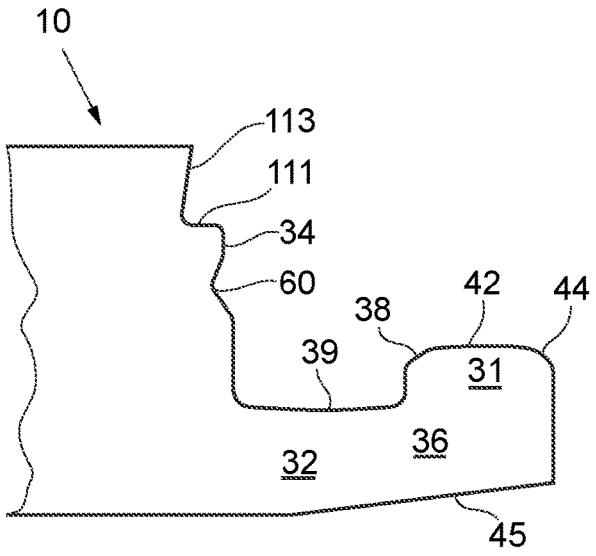
FIGS. 17 and 18 shows a first and second panel comprising vertical locking means according to one embodiment.
Figure 18:
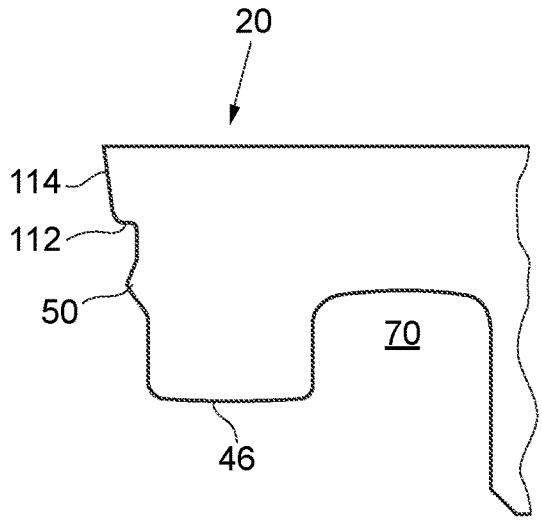

Turning now to FIGS. 17 and 18, in which the joining system is shown comprising a vertical locking means 50, 60 being formed by a triangular recess 60 on the female coupling on the first panel 10 and a by a triangular protrusion 50 on the male coupling on the second panel 20 respectively. The triangular protrusion 50 and triangular recess 60 are in some materials preferred in relation the rounded bulb and recess shown in other embodiments.

As is previously mentioned, the first and second panels 10, 20 may also comprise joint surfaces 113, 114 having a negative angle or inclination such that a small space is formed between the joint surfaces 113, 114 when the panels 10, 20 are joined together. In another embodiment, the joint surfaces 113, 114 are essentially vertical and wherein at least the joint surface 113 on the first panel 10 or the joint surface 114 on the second panel comprises a recess forming a space between the joint surfaces 113, 114 when the first and second panels 10, 20 are joined together. While the embodiments of FIGS. 17 and 18 are shown together, it is to be realized that each of the embodiments may be applied separately to the first and second panel 10, 20 respectively.

Turning now to FIG. 19 in which a further embodiment of the joining system is shown. The joining system in FIG. 19 comprises a first panel 10 and a second panel 20 having a female coupling and a male coupling respectively, as described in relation to FIGS. 1 to 4. The male coupling shown in FIG. 19 further comprises a clearance surface **46*a*, the clearance surface 46*a* being arranged proximal of and adjacent to the bottom surface 46 on the male coupling tongue 40. The clearance surface 46*a* is preferably chamfered or rounded such that the second panel 20 can more easily be joined with the first panel 10 by folding/angling. Further still, the clearance surface 46*a* facilitates that the second panel 20 can be released from the first panel 10 by pivoting the second panel 20 around the contact between the male coupling tongue 40 and the female recess 30, whereby the clearance surface 46*a* pushes the female coupling tongue 32** downwards and thus releases the connection.

The abutment surface 47 on the male coupling tongue 40 is preferably arranged at an angle in relation to the horizontal plane SP in which the floor panels 10, 20 are laid. The angle of the abutment surface 47 may be between 50° and 70°, preferably approximately 60°. The abutment surface 47 is configured to abut against the inclined abutment surface 38 on the female coupling tongue 32, the inclined abutment surface 38 is preferably arranged such that it faces the abutment surface 47 and is essentially parallel therewith.

Figure 20:
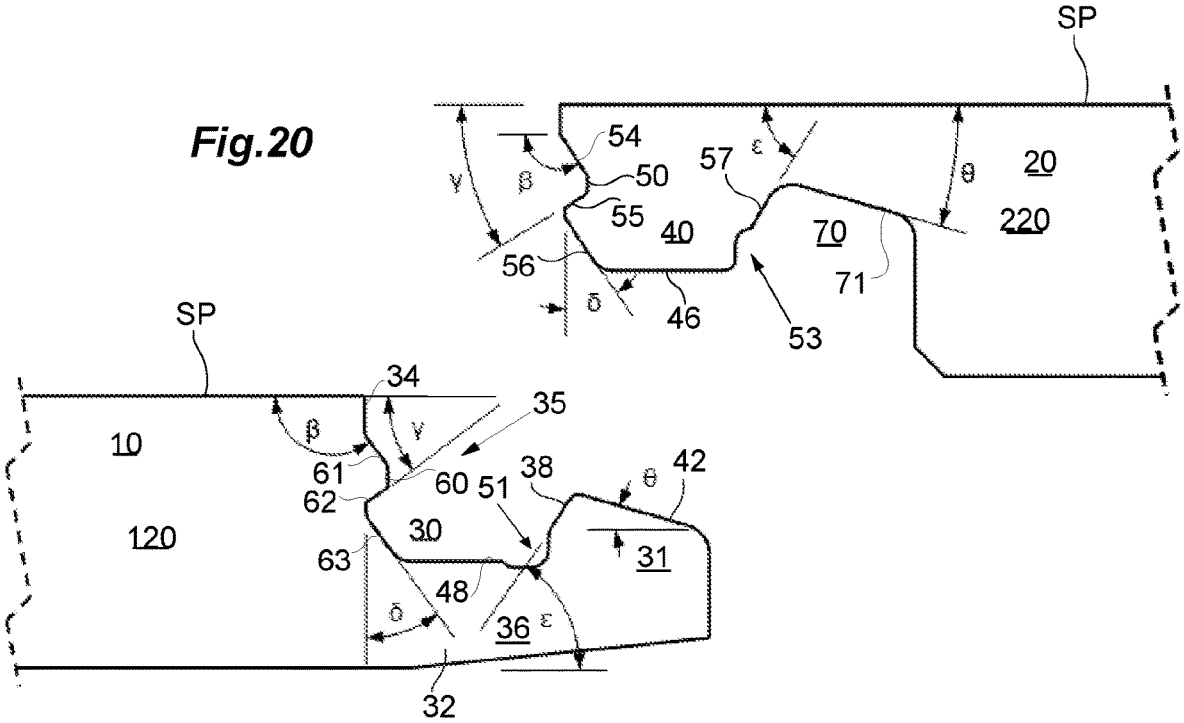
FIGS. 20 and 21 show a side-by-side view and a connected view of a joining system according to one embodiment.
Figure 21:
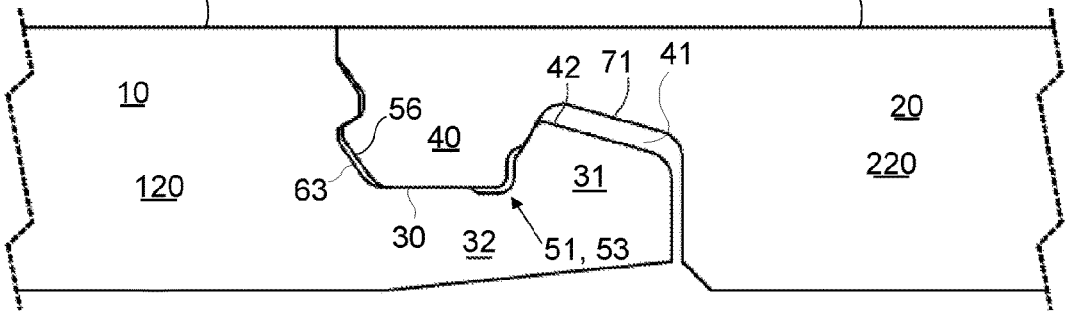

FIGS. 20 and 21 discloses another embodiment of the joining system, shown in a side-by-side view and in connected view respectively. The embodiment shown in FIGS. 20 and 21 shares many features with the embodiments described in the foregoing and features can thus be combined freely with any of the embodiments described herein.

The embodiment shown in FIGS. 20 and 21 facilitate connection of the first panel 10 and the second panel 20 both by means of fold-down and/or by angle-in. The second panel 20 may further be released from the first panel 10 by means of pivoting second panel 20 around the contact between the male coupling tongue 40 and the female recess 30. The first and second panel 10, 20 may further be released by means of the coupling release tool 110 and/or by means sliding the two panels 10, 20 in the longitudinal direction in relation to one another.

The female coupling comprises a protruding vertical locking means 60 arranged on the side 35 of the female coupling recess 30. The protruding vertical locking means 60 being configured to cooperate with a corresponding recessed vertical locking means 50 in the male coupling on the side of the male coupling tongue 40.

An upper inclined surface 61 may be provided on the vertical locking means 60 on the first panel 10, which is configured to be arranged facing a corresponding upper inclined surface 54 in the recessed vertical locking means 50 on the second panel 20 when the first and second panels 10, 20 are joined together as shown in FIG. 21. As is illustrated in FIG. 20, the upper inclined surface 61 on the first panel 10 and the upper inclined surface 54 on the second panel 20 may respectively be arranged at an angle β in relation to a plane parallel with the surface plane SP. Preferably, the angle β is essentially the same for both the first and second panel 10, 20. The angle β may be between 100° to 150°, preferably approximately 125°.

The upper inclined surface 61 is adjacent to and forms an extension of the upper guiding surface 34 on the first panel 10. When connecting, e.g. by folding, the two panels 10, 20 together, the upper inclined surface 61 on the first panel 10 and the upper inclined surface 54 on the second panel 20 will slidingly cooperate to achieve connection between the panels 10, 20 and the male coupling tongue 40 will resiliently depress/deflect the female coupling tongue 32 during insertion until the two panels 10, 20 are joined together.

A lower inclined surface 62 may be provided on the vertical locking means 60 of the first panel 10, the lower inclined surface 62 being configured to be arranged facing a corresponding lower inclined surface 55 on the second panel 20 when the first and second panels 10, 20 are joined together as shown in FIG. 21.

As is illustrated in FIG. 20, the lower inclined surface 62 on the first panel 10 and the lower inclined surface 55 on the second panel 20 may respectively be arranged at an angle γ in relation to a plane parallel with the surface plane SP. Preferably, the angle γ is essentially the same for both the first and second panel 10, 20. The angle γ may be between 20° and 40°, preferably approximately 30°. The cooperation between the lower inclined surfaces 55, 62 on the first and second panel 10, 20 respectively provides vertical locking. As such, the angle γ should preferably not be to large as this could result in that the vertical lock becomes to weak as the surfaces 62, 55 could start sliding against each other when the friction between them is overcome. A smaller angle γ is thus preferred and angles less than 20° are also envisioned. The female coupling recess 30 may further be provided with an inclined side surface 63 configured to be arranged facing a corresponding inclined side surface 56 on the male coupling tongue 40. The inclined side surface 63 being arranged on the side of the female recess 30 near the main portion 120 of the first panel 10, while the inclined side surface 56 on the male coupling tongue 40 is arranged on the side thereof which faces away from the main portion 220 of the second panel 20.

The inclined side surface 63 on the first panel 10 and the inclined side surface 56 on the second panel 20 may respectively be arranged at an angle δ in relation to a vertical plane. Preferably, the angle δ is essentially the same for both the first and second panel 10, 20. The angle δ may be between 20° and 50°, preferably approximately 35°.

The bottom surface 48 of the female coupling recess 30 is essentially parallel to the surface plane SP, as is the corresponding bottom surface 46 of the male coupling tongue 40. However, these surfaces 46, 48 may be arranged at other orientations in relation to the surface plane SP as well.

The female coupling recess 30 may further be provided with a corner recess 51. The corner recess 51 is arranged in the corner of the recess 30 arranged farthest from the main portion 120 of the first panel 10. The bottom surface 48 is arranged between the corner recess 51 and the inclined side surface 63. The corner recess 51 is recessed below the bottom surface 48.

The male coupling tongue 40 may be provided with a corner recess 53 which is intended to be arranged facing the corner recess 51 in the female coupling recess 30. The male coupling tongue 40 and the female coupling recess 30 will thus not be in contact with each other in the portions thereof which constitutes the respective corner recesses 51, 53.

The respective corner recess 51, 53 may be especially beneficial if the second panel 20 is to be released from the first panel 10 by pivoting around the male coupling tongue 40, which will thus not immediately come into contact with the locking protrusion 31 due to the presence of the respective corner recesses 51, 53. A pivoting movement of the second panel 20 can thus be achieved without generating large strains by the male coupling tongue 40 pushing on the female locking protrusion 31, which could be the case if the male coupling tongue 40 entirely conformed to the shape of the female recess 30. The risk of failure of the joining system due to structural failure of the female coupling tongue 32 during release of the joining system by pivoting can thus be reduced.

The corner recess 51 in the female coupling recess 30 may further facilitate connecting the first and second panel 10, 20 together, as it improves resilience in the female coupling tongue 32. Specifically may the locking protrusion 31 thereof resiliently bend outwards and downwards, for instance by a force generated thereon by the male coupling tongue 40 during sliding cooperation of the upper inclined surfaces 61, 54 when connecting the panels 10, 20, as explained above.

An inclined abutment surface 38 of the female coupling tongue 32, in the female coupling recess 30, is provided. The inclined abutment surface 38 is configured to be arranged facing a corresponding inclined abutment surface 57 on the male coupling tongue 40. The inclined abutment surface 38 being arranged on the side of the female recess 30 farthest from the main portion 120 of the first panel 10, while the inclined abutment surface 57 on the male coupling tongue 40 is arranged on the side thereof which faces towards from the main portion 220 of the second panel 20.

The inclined abutment surface 38 on the first panel 10 and the inclined abutment surface 57 on the second panel 20 may respectively be arranged at an angle ε in relation to a plane parallel with the surface plane SP. Preferably, the angle ε is essentially the same for both the first and second panel 10, 20. The angle ε may be between 40° and 80°, preferably approximately 60°.

The inclined abutment surface 38 on the first panel 10 is configured to abut against the inclined abutment surface 57 on the second panel 20, thus forming a horizontal lock such that the first and second panel 10, 20 cannot move horizontally away from each other. The inclined abutment surface 38 of the first panel may be arranged between the corner recess 51 and a top surface 42 of the female locking protrusion 31. The inclined abutment surface 57 on the second panel 20 may be arranged between the corner recess 53 and an upper surface 71 in the groove 70 in the second panel 20.

The female locking protrusion 31 may further be provided with an inclined top surface 42, which is configured to be arranged facing a corresponding inclined upper surface 71 in the groove 70 in the second panel 20. The respective inclined top and upper surfaces 42, 71 between them form the coupling release channel 41.

The inclined top surface 38 on the first panel 10 and the inclined upper surface 71 on the second panel 20 may respectively be arranged at an angle θ in relation to a plane parallel with the surface plane SP. Preferably, the angle θ is essentially the same for both the first and second panel 10, 20. The angle θ may be between 0° and 40°, preferably approximately 16°.

The height G of the locking protrusion 31 and/or the distance R, as illustrated in FIG. 1*b* but applied to FIGS. 20-23, may affect the properties of the joining system in respect of if fold-down or angle-in is facilitated. For instance, having a locking protrusion 31 with a high height G and/or large distance R may generate a joining system that is easier to fold-down than it is to angle-in while the opposite is generated with a low height G and/or distance R. The joining system disclosed herein may thus be adapted such that both fold-down and angle-in is possible, or such that one of the two aforementioned ways of assembling the joining system is facilitated, by adapting the height G and/or distance R accordingly. Moreover, the relationship between the distance from the vertical locking means 60 to the locking protrusion 31 and the shape of the locking protrusion 31, i.e. the height G and/or distance R thereof, will also affect the properties of the joining system in respect of if fold-down or angle-in is facilitated, or both.

Figure 22:
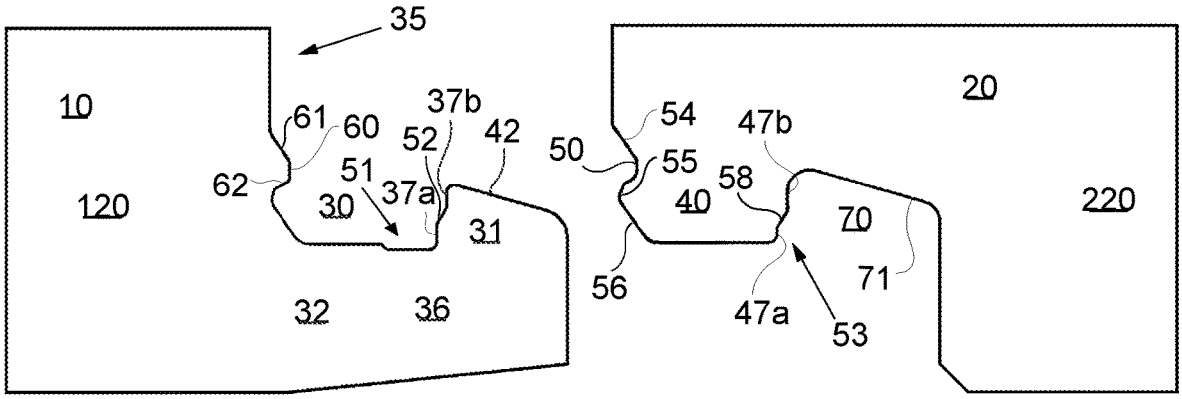
FIGS. 22 and 23 show a side-by-side view and a connected view of a joining system according to one embodiment.
Figure 23:
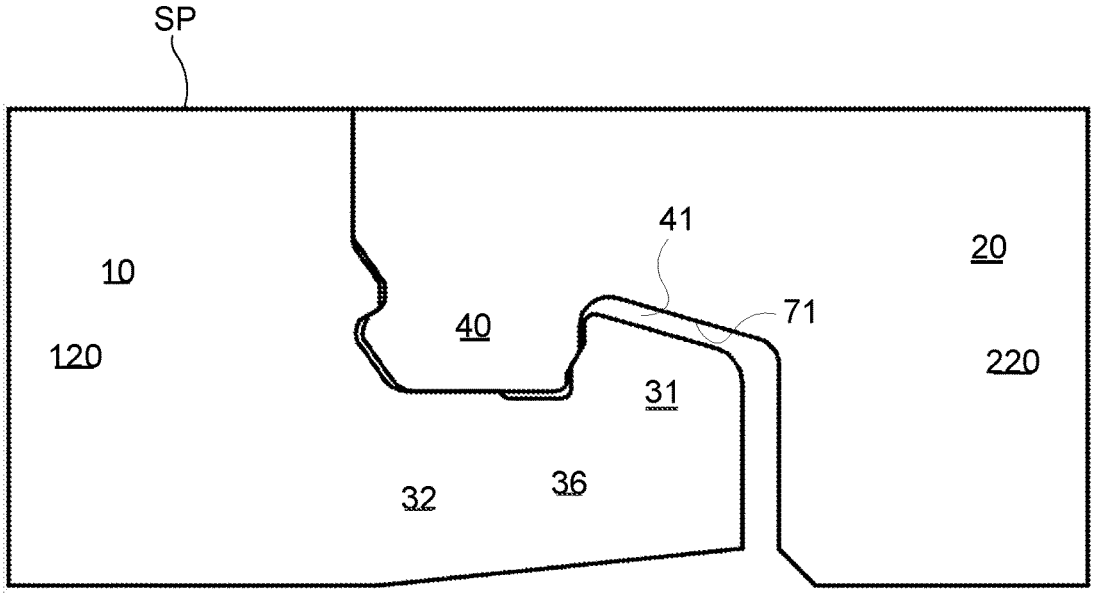

Turning lastly to FIGS. 22 and 23, in which another embodiment of the joining system is shown. The embodiment shown in FIGS. 22 and 23 shares many features with the embodiments described in the foregoing and features thereof can thus be combined freely with any of the previously described embodiments.

The embodiment in FIGS. 22 and 23 shares many features with the embodiment in FIGS. 21 and 22, reference is thus made to the above for the common features while the description below will focus on the differing features.

The first and second panel 10, 20 may as shown be provided with a respective corner recess 51, 53. The female locking protrusion 31 is further provided with a first vertical abutment surface 37*a* and a second vertical abutment surface 37*b*. The first and second vertical abutment surfaces 37*a*, 37*b* being offset from each other in the direction of the surface plane SP.

An inclined abutment surface 52 is arranged between and adjoining the first and second vertical abutment surfaces 37*a*, 37*b*.

The male coupling tongue 40 is provided, on the side thereof facing the main portion 220 of the second panel 20, with first and second abutment surfaces 47*a*, 47*b* which are vertically arranged and corresponding to the vertical abutment surfaces 37*a*, 37*b* on the first panel 10.

The first and second abutment surfaces 47*a*, 47*b* being offset from each other in the direction of the surface plane SP and configured to be arranged facing the vertical abutment surfaces 37*a*, 37*b* when the two panels 10, 20 are connected. An inclined abutment surface 58 is arranged between and adjoining the first and second abutment surfaces 47*a*, 47*b* on the male coupling tongue 40, configured to be arranged facing the inclined abutment surface 52 in the female coupling recess 30 when the first and second panels 10, 20 are connected. The shape of the locking protrusion 31 and correspondingly of the male coupling tongue 40 provides a strong lock in the horizontal direction, i.e. in the surface plane SP which prevents a gap forming between the first and second panels 10, 20.

The embodiment illustrated in FIGS. 22 and 23 facilitates connection of the first panel 10 and the second panel 20 both by means of fold-down and/or by angle-in. The second panel 20 may further be released from the first panel 10 by means of pivoting second panel 20 around the contact between the male coupling tongue 40 and the female recess 30. The first and second panel 10, 20 may further be released by means of the coupling release tool 110 and/or by means sliding the two panels 10, 20 in the longitudinal direction in relation to one another.

The joining system according to the invention is equally applicable to a wide variety of materials, such as for example solid wood, laminated wood, different types of fibreboard materials like MDF or HDF materials, plastic or composite polymer materials like PVC or LVT or other polymer materials and metals such as aluminium. The joining system may also be used for joining hollow profile beams in plastic, steel or aluminium.

It will be appreciated that the present invention is not limited to the embodiments shown. Several modifications and variations are thus conceivable within the scope of the invention which thus is exclusively defined by the appended claims.

The invention claimed is:

1. A fold-down joining system for floor panels, comprising a fold-down female coupling formed in one piece with a first floor panel and a fold-down male coupling formed in a second floor panel, the fold-down female coupling comprising:

a female coupling recess being arranged on a female coupling tongue protruding away from a main portion of the first floor panel towards the adjoining second floor panel, the female coupling recess being adapted to receive a male coupling tongue projecting from the adjoining second floor panel in a direction away from a main floor surface plane in which the floor panels are laid, the fold-down female coupling further comprises an upper guiding surface being located on a side of the female coupling recess on the first floor panel forming a guide for the male coupling tongue upon insertion thereof, limiting movement of said male coupling tongue in a horizontal direction towards the main portion of the first floor panel;

the fold-down male coupling comprising:

the male coupling tongue formed in one piece in the second floor panel, the fold-down male coupling being provided with vertical locking means enabling a vertical interlocking engagement with a matching one piece vertical locking means of the fold-down female coupling, wherein the female coupling tongue is resilient and comprises a distally arranged locking protrusion protruding from the female coupling tongue in a direction towards the main floor surface plane and being arranged to be received in a groove in the second floor panel for horizontal locking of the panels, wherein the locking protrusion is configured to come into contact with the male coupling tongue during joining of the first and second floor panels, the female coupling tongue further comprising a lower recess, enabling the locking protrusion of the female coupling tongue to be depressed during joining of the panels, the fold-down joining system being configured for release by a coupling release tool or by pivoting the second floor panel in relation to the first floor panel, wherein the fold-down joining system further comprises:

a coupling release channel being arranged between the locking protrusion and an upper surface in the groove in the second floor panel, such that the coupling release tool is placeable in the coupling release channel for engaging the female coupling tongue, to depress the female coupling tongue to release the horizontal locking from the locking protrusion and/or to release the vertical locking means, or an inclined abutment surface provided on the male coupling tongue for abutment with the locking protrusion of the female coupling tongue, or an inclined abutment surface provided on the locking protrusion of the female coupling tongue for abutment against the male coupling tongue;

wherein the lower recess extends on the underside of the female coupling tongue a distance, from a distal surface thereof to between 60% to 90% of the length of the female coupling tongue, or wherein the male coupling tongue has a protrusion length, measured from a bottom surface of the male coupling tongue to the upper surface of the groove in the second floor panel, of between 10% to 40% of a thickness of the second floor panel.

2. The joining system for floor panels according to claim 1, wherein the lower recess extends from a distal surface of the female coupling tongue, the lower recess having a greater extension than the width of the locking protrusion.

3. The joining system for floor panels according to claim 1, wherein the lower recess extends on the underside of the female coupling tongue a distance, from a distal surface thereof approximately 85% of the length of the female coupling tongue as measured from the distal surface.

4. The joining system for floor panels according to claim 1, wherein the lower recess is defined by an inclined surface extending a distance from a distal surface of the female coupling tongue to between 60% to 90% of the length of the female coupling tongue.

5. The joining system for floor panels according to claim 1, wherein the locking protrusion further comprises an inclined abutment surface arranged between an essentially vertical abutment surface on the female locking tongue and the top surface of the female locking tongue, the essentially vertical abutment surface and/or the inclined abutment surface cooperating with an abutment surface on the male coupling tongue to prevent horizontal movement of the panels away from each other.

6. The joining system for floor panels according to claim 1, wherein the first floor panel comprises a support surface being configured to cooperate with a support surface on the second floor panel to provide a vertical support when the first and second floor panel are connected.

7. The joining system for floor panels according to claim 6, wherein the second floor panel further comprises an upper joint surface adjoining the support surface, the upper joint surface being configured to abut against an upper joint surface on the first floor panel when the first and second floor panels are joined together.

8. The joining system for floor panels according to claim 7, wherein the support surface and the joint surface on the second floor panel together form a protrusion which corresponds to a recess, formed by the support surface and the upper joint surface on the first floor panel.

9. The joining system for floor panels according to claim 7, wherein the joint surface protrudes a distance horizontally from the male coupling tongue, the distance being larger than a distance which the vertical locking means protrudes from the male coupling tongue, such that the vertical locking means is positioned closer to the main portion of the second floor panel than the joint surface.

10. The joining system for floor panels according to claim 1, wherein the male coupling tongue is rigid and non-resilient.

11. The joining system for floor panels according to claim 1, wherein a distance between the upper surface of the groove and a top surface of the locking protrusion when the first and second floor panels are joined together is between 10% to 40% of the thickness of the first and second floor panel.

12. The joining system according to claim 1, further comprising the coupling release tool placeable in the coupling release channel for depressing the female coupling tongue and thereby release the lock.

13. The joining system for floor panels according to claim 1, wherein the male coupling tongue comprises a bottom surface configured to face a female coupling recess bottom surface, and wherein the shape of the bottom surface corresponds to the shape of the female coupling recess bottom surface.

14. The joining system for floor panels according to claim 1, wherein a horizontal channel is provided between the female coupling tongue and a main portion of the second floor panel, wherein the horizontal channel enables horizontal movement of the female coupling tongue.

15. The joining system for floor panels according to claim 14, wherein a horizontal distance from a distal surface of the female coupling tongue and a distal surface of the main portion of the second floor panel is between 5% and 15% of the length of the female coupling member.

16. A floor panel comprising a female coupling formed along at least one first side of the floor panel for interconnecting the floor panel to a male coupling of a second floor panel, the female coupling comprising:

a female coupling recess being arranged on a female coupling tongue protruding away from a main portion of the floor panel towards the adjoining second floor panel, the female coupling recess being adapted to receive a male coupling tongue projecting from the adjoining second floor panel in a direction away from a main floor surface plane in which the floor panels are laid, an upper guiding surface being located on a side of the female coupling recess on the floor panel forming a guide for the male coupling tongue upon insertion thereof, limiting movement of said male coupling tongue in a horizontal direction towards the main portion of the floor panel, a vertical locking means configured to cooperate with vertical locking means in the male coupling, enabling a vertical interlocking engagement therewith, wherein the female coupling tongue is resilient and comprises a distally arranged locking protrusion protruding from the female coupling tongue in a direction towards the main floor surface plane and being arranged to be received in a groove in the second panel for horizontal locking of the panels, wherein the locking protrusion is configured to come into contact with the male coupling tongue during joining of the floor panels, the female coupling tongue further comprising a lower recess, enabling the locking protrusion of the female coupling tongue to be depressed during joining of the panels, wherein the female coupling is configured for release from the second floor panel by a coupling release tool or by pivoting the second floor panel in relation to the floor panel, wherein the female coupling forms at least a part of:

a coupling release channel being arranged between the locking protrusion and an upper surface in the groove in the second floor panel, such that the coupling release tool is placeable in the coupling release channel and can engage the female coupling tongue, to depress the female coupling tongue to release the horizontal locking from the locking protrusion and/or to release of the vertical locking means, or comprises:

an inclined abutment surface provided on the locking protrusion of the female coupling tongue for abutment against the male coupling tongue;

wherein the lower recess extends on the underside of the female coupling tongue a distance, from a distal surface thereof to between 60% to 90% of the length of the female coupling tongue.

17. The floor panel, according to claim 16, wherein the floor panel further comprises a second female coupling formed along a side substantially perpendicular to the at least one first side of the floor panel, for interconnecting the floor panel to a male coupling of a second floor panel, the second female coupling comprising:

a female coupling recess being arranged on a female coupling tongue protruding away from a main portion of the floor panel towards the adjoining second floor panel, the female coupling recess being adapted to receive a male coupling tongue projecting from the adjoining second floor panel in a direction away from a main floor surface plane in which the floor panels are laid, an upper guiding surface being located on a side of the female coupling recess on the floor panel forming a guide for the male coupling tongue upon insertion thereof, limiting movement of said male coupling tongue in a horizontal direction towards the main portion of the floor panel, a vertical locking means configured to cooperate with vertical locking means in the male coupling, enabling a vertical interlocking engagement therewith, wherein the female coupling tongue is resilient and comprises a distally arranged locking protrusion protruding from the female coupling tongue in a direction towards the main floor surface plane and being arranged to be received in a groove in the second floor panel for horizontal locking of the panels, wherein the locking protrusion is configured to come into contact with the male coupling tongue during joining of the floor panels, the female coupling tongue further comprising a lower recess enabling the locking protrusion of the female coupling tongue to be depressed during joining of the panels, wherein the second female coupling is configured for release from the second floor panel by a coupling release tool or by pivoting the second floor panel in relation to the floor panel, wherein the second female coupling forms at least a part of:

a coupling release channel being arranged between the locking protrusion and an upper surface in the groove in the second floor panel, such that the coupling release tool is placeable in the coupling release channel and can engage the female coupling tongue, to depress the female coupling tongue to release the horizontal locking from the locking protrusion and/or to release of the vertical locking means, or comprises:

an inclined abutment surface provided on the locking protrusion of the female coupling tongue for abutment against the male coupling tongue;

wherein the lower recess extends on the underside of the female coupling tongue a distance, from a distal surface thereof to between 60% to 90% of the length of the female coupling tongue.

18. The floor panel according to claim 16, wherein the floor panel further comprises a first male coupling formed along a side parallel to the at least one first side of the floor panel, for interconnecting the floor panel to a female coupling of a further floor panel, the male coupling comprising a male coupling tongue projecting from the floor panel in a direction away from a main floor surface plane in which the floor panels are laid, the male coupling tongue being formed in one piece in the floor panel, wherein the male coupling is provided with vertical locking means enabling a vertical interlocking engagement with the matching vertical locking means of the female coupling, a groove in the floor panel being arranged to receive the distally arranged locking protrusion protruding from the female coupling tongue for horizontal locking of the panels, wherein the male coupling is configured for release from release from the further panel by a coupling release tool or by pivoting the floor panel in relation to the further panel, wherein the male coupling forms at least a part of:

a coupling release channel being arranged between the locking protrusion and an upper surface in the groove in the floor panel, such that the coupling release tool is placeable in the coupling release channel for engaging the female coupling tongue, to depress the female coupling tongue to release the horizontal locking from the locking protrusion and/or to release the vertical locking means, or comprises:

an inclined abutment surface provided on the locking protrusion of the female coupling tongue for abutment against the male coupling tongue, or wherein the male coupling tongue has a protrusion length, measured from a bottom surface of the male coupling tongue to the upper surface of the groove in the floor panel, of between 10% to 40% of a thickness of the floor panel.

19. The floor panel according to claim 18, wherein the floor panel further comprises a second male coupling formed along a side substantially perpendicular to the side on which the first male coupling is formed, the second male coupling being adapted for interconnecting the floor panel to a female coupling on a further floor panel, the second male coupling comprising:

a male coupling tongue projecting from the floor panel in a direction away from a main floor surface plane in which the floor panels are laid, the male coupling tongue being formed in one piece in the floor panel, wherein the male coupling is provided with vertical locking means enabling a vertical interlocking engagement with the matching vertical locking means of the female coupling, a groove in the floor panel being arranged to receive the distally arranged locking protrusion protruding from the female coupling tongue for horizontal locking of the panels, wherein the male coupling is configured for release from release from the further panel by a coupling release tool or by pivoting the floor panel in relation to the further panel, wherein the male coupling forms at least a part of:

a coupling release channel being arranged between the locking protrusion and an upper surface in the groove in the floor panel, such that the coupling release tool is placeable in the coupling release channel and can engage the female coupling tongue, to depress the female coupling tongue to release the horizontal locking from the locking protrusion and/or to release the vertical locking means, or comprises:

an inclined abutment surface provided on the locking protrusion of the female coupling tongue for abutment against the male coupling tongue, or wherein the male coupling tongue has a protrusion length, measured from a bottom surface of the male coupling tongue to the upper surface of the groove in the floor panel, of between 10% to 40% of a thickness of the floor panel.

20. A fold-down flooring system comprising a first floor panel having a fold-down female coupling arranged on a short side thereof and being formed in one piece therewith, a fold-down male coupling arranged on an opposite short side thereof, a fold-down female coupling arranged on a long side thereof and a fold-down male coupling being arranged on an opposite long side thereof, the fold-down flooring system further comprising a second floor panel being identical with the first floor panel but mirrored either in a vertical plane along one of the short sides of the first floor panel or in a vertical plane along one of the long sides of the first floor panel, each fold-down female coupling of the first floor panel comprising:

a female coupling recess being arranged on a female coupling tongue protruding away from a main portion of the first floor panel towards the adjoining second floor panel, the female coupling recess being adapted to receive a male coupling tongue projecting from the adjoining second floor panel in a direction substantially perpendicular to a main floor surface plane in which the floor panels are laid, the fold-down female coupling further comprises an upper guiding surface being located on a side of the female coupling recess on the first floor panel forming a guide for the male coupling tongue upon insertion in a downward direction thereof, limiting movement of said male coupling tongue in a horizontal direction towards the main portion of the first floor panel;

each fold-down male coupling of the first floor panel comprising:

the male coupling tongue formed in one piece in the first floor panel, the fold-down male coupling being provided with vertical locking means enabling a vertical interlocking engagement with a matching on-piece vertical locking means of the fold-down female coupling, wherein the female coupling tongue is resilient and comprises a distally arranged locking protrusion protruding from the female coupling tongue in a direction towards the main floor surface plane and being arranged to be received in a groove in the second floor panel for horizontal locking of the panels, wherein the locking protrusion is configured to come into contact with the male coupling tongue of the second floor panel during joining of the floor panels, the female coupling tongue further comprising a lower recess, enabling the locking protrusion of the female coupling tongue to be depressed during joining of the panels, the flooring system being configured for assembly in a downward direction and release by a coupling release tool or by pivoting the second floor panel in relation to the first floor panel, wherein the fold-down flooring system further comprising:

a coupling release channel being arranged between the locking protrusion of the first floor panel and an upper surface in the groove in the second floor panel, such that the coupling release tool is placeable in the coupling release channel for engaging the female coupling tongue, to depress the female coupling tongue to release the horizontal locking from the locking protrusion and/or to release the vertical locking means, or an inclined abutment surface provided on the male coupling tongue for abutment with the locking protrusion of the female coupling tongue, or an inclined abutment surface provided on the locking protrusion of the female coupling tongue for abutment against the male coupling tongue;

wherein the lower recess extends on the underside of the female coupling tongue a distance, from a distal surface thereof to between 60% to 90% of the length of the female coupling tongue, or wherein the male coupling tongue has a protrusion length, measured from a bottom surface of the male coupling tongue to the upper surface of the groove in the second floor panel, of between 10% to 40% of a thickness of the second floor panel.

* * * * *